US009537244B2

(12) United States Patent
Miyazaki et al.

(10) Patent No.: US 9,537,244 B2
(45) Date of Patent: Jan. 3, 2017

(54) CONNECTOR HAVING AN ATTACHMENT PIECE NOT ALIGNED WITH A PROTRUSION FORMED IN A SIDEWALL OF THE CONNECTOR BODY

(71) Applicant: Panasonic Intellectual Property Management Co., Ltd., Osaka (JP)

(72) Inventors: Yoji Miyazaki, Mie (JP); Masaki Fujimoto, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/770,815

(22) PCT Filed: Feb. 27, 2013

(86) PCT No.: PCT/JP2013/001153

§ 371 (c)(1),
(2) Date: Oct. 20, 2015

(87) PCT Pub. No.: WO2014/132285

PCT Pub. Date: Sep. 4, 2014

(65) Prior Publication Data

US 2016/0049744 A1 Feb. 18, 2016

(51) Int. Cl.
*H01R 24/00* (2011.01)
*H01R 13/42* (2006.01)
(Continued)

(52) U.S. Cl.
CPC ..... *H01R 13/42* (2013.01); *H01R 12/57* (2013.01); *H01R 12/712* (2013.01); *H01R 12/73* (2013.01)

(58) Field of Classification Search
CPC ..... H01R 12/57; H01R 12/712; H01R 12/73; H01R 13/42; H01R 13/514
(Continued)

(56) References Cited

U.S. PATENT DOCUMENTS 5,545,051 A 8/1996 Summers et al.
5,876,217 A 3/1999 Ito et al.
(Continued)

FOREIGN PATENT DOCUMENTS

CN 1166066 A 11/1997
CN 1173056 A 2/1998
(Continued)

OTHER PUBLICATIONS

International Search Report and Written Opinion issue in corresponding International Patent Application No. PCT/JP2013/001153, mailed on May 7, 2013; 5 pages with English translation.
(Continued)

*Primary Examiner* — Chandrika Prasad
(74) *Attorney, Agent, or Firm* — McDermott Will & Emery LLP

(57) ABSTRACT

A connector includes: a socket having a socket fitting body provided with socket terminals; and a header having a header fitting body provided with header terminals. At least one of a sidewall surface on an inner side of the socket fitting body and a sidewall surface on an outer side of the header fitting body includes a protrusion in which at least one side surface of the both side surfaces in the width direction faces the corresponding opposite surface formed in the sidewall surface of the other fitting body with the socket and header fitting bodies fitted to each other.

17 Claims, 17 Drawing Sheets

(51) Int. Cl.
*H01R 12/57* (2011.01)
*H01R 12/73* (2011.01)
*H01R 12/71* (2011.01)

(58) Field of Classification Search
USPC ..... 439/74, 626
See application file for complete search history.

(56) References Cited

U.S. PATENT DOCUMENTS

| | | | | |
|---|---|---|---|---|
| 5,975,916 | A * | 11/1999 | Okura | H01R 12/716 439/660 |
| 6,623,308 | B2 * | 9/2003 | Ono | H01R 13/26 439/660 |
| 7,568,919 | B2 * | 8/2009 | Hoshino | H01R 12/716 439/74 |
| 8,087,942 | B2 * | 1/2012 | Chen | B41J 13/12 439/74 |
| 8,827,698 | B2 * | 9/2014 | Lai | A61C 7/145 433/11 |
| 8,888,506 | B2 * | 11/2014 | Nishimura | H01R 12/7082 439/74 |
| 9,124,011 | B2 * | 9/2015 | Miyazaki | H01R 12/716 |
| 9,350,097 | B2 * | 5/2016 | Yunoki | H01R 12/716 |
| 9,356,407 | B2 * | 5/2016 | Nakamura | H01R 24/68 |
| 2005/0009383 | A1 | 1/2005 | Okura et al. | |
| 2007/0105408 | A1 | 5/2007 | Ookura | |
| 2008/0207010 | A1 | 8/2008 | Ono | |
| 2009/0061655 | A1 * | 3/2009 | Miyazaki | H01R 12/57 439/74 |
| 2009/0280658 | A1 | 11/2009 | Hoshino et al. | |
| 2010/0221928 | A1 | 9/2010 | Sato et al. | |
| 2010/0330821 | A1 | 12/2010 | Takeuchi et al. | |
| 2014/0378007 | A1 * | 12/2014 | Miyazaki | H01R 12/716 439/816 |
| 2016/0013573 | A1 * | 1/2016 | Miyazaki | H01R 12/716 439/626 |

FOREIGN PATENT DOCUMENTS

| | | | |
|---|---|---|---|
| CN | 1189251 | A | 7/1998 |
| CN | 1545750 | A | 11/2004 |
| CN | 1771634 | A | 5/2006 |
| CN | 200953399 | Y | 9/2007 |
| CN | 101257162 | A | 9/2008 |
| CN | 201266731 | Y | 7/2009 |
| CN | 101820114 | A | 9/2010 |
| CN | 101911397 | A | 12/2010 |
| CN | 102570080 | A | 7/2012 |
| CN | 202737227 | U | 2/2013 |
| EP | 0 814 645 | A1 | 12/1997 |
| JP | 2003-173831 | | 6/2003 |
| JP | 2005-019144 | A | 1/2005 |
| JP | 2012-138320 | A | 7/2012 |
| JP | 2013-016410 | A | 1/2013 |
| KR | 10-2009-0117979 | A | 11/2009 |
| WO | 2011/031719 | A2 | 3/2011 |

OTHER PUBLICATIONS

First Office Action issued in corresponding Chinese Patent Application No. 201380073837.2, mailed on Sep. 2, 2016; with English translation.

Korean Notification of Reason for Refusal dated Oct. 4, 2016 issued in Korean Patent Application No. 10-2015-7023177 (English translation).

* cited by examiner

CONNECTOR HAVING AN ATTACHMENT PIECE NOT ALIGNED WITH A PROTRUSION FORMED IN A SIDEWALL OF THE CONNECTOR BODY

RELATED APPLICATIONS

This application is the U.S. National Phase under 35 U.S.C. §371 of International Patent Application No. PCT/JP2013/001153, filed on Feb. 27, 2013, the disclosure of which Application is incorporated by reference herein.

TECHNICAL FIELD

The present invention relates to a connector and to a header and a socket to be used in the connector.

BACKGROUND ART

One of conventionally known connectors includes: a socket having plural socket terminals provided in a socket body; and a header including plural header terminals provided in a header body (for example, see Patent Literature 1).

In Patent Literature 1, the socket and header are fitted to each other to bring the terminals of the socket into contact with the corresponding terminals of the header for electrical continuity. Conductor patterns of circuit substrates connected to the respective terminals are thereby electrically connected to each other.

CITATION LIST

Patent Literature

Patent Literature 1: Japanese Patent Laid-open Publication No. 2005-019144

SUMMARY OF INVENTION

Technical Problem

In the above-described type of connectors, it is more preferable that the socket and header can be easily fitted to each other.

Accordingly, an object of the present invention is to obtain a connector including a socket and a header which can be easily fitted to each other as well as the socket and header to be used in the connector.

Solution to Problem

A first aspect of the present invention is a connector including: a socket having a socket fitting body provided with socket terminals; and a header having a header fitting body provided with header terminals, the socket fitting body and header fitting body being fitted to each other to bring the socket terminals and header terminals in contact with each other. In the same connector, at least one of a sidewall surface on an inner side of the socket fitting body and a sidewall surface on an outer side of the header fitting body includes a protrusion in which at least one side surface of the both side surfaces in the width direction faces the corresponding opposite surface formed in the sidewall surface of the other fitting body with the socket and header fitting bodies fitted to each other.

In a second aspect of the present invention, the opposite surface is formed in a portion of the sidewall surface on the outer side of the header fitting body.

In a third aspect of the present invention, the opposite surface is provided from the vicinity of an end of the sidewall surface on the outer side of the header fitting body, the end being on the side fitted to the socket fitting body, to the vicinity of the opposite end of the same sidewall surface.

In a fourth aspect of the invention, the socket fitting body includes a plate-shaped wall portion on the side opposite to the side fitted to the header fitting body, and in the sidewall surface on the inner side of the socket fitting body, the protrusion is provided from the vicinity of an end on the side fitted to the header fitting body to the vicinity of the plate-shaped wall portion.

In a fifth aspect of the invention, the opposite surface include at least a pair of opposite surfaces which are formed at the positions point-symmetric about the center of the header fitting body in a planar view.

In a sixth aspect of the invention, the header fitting body is rectangular, and the opposite surfaces are formed at both ends of the header fitting body in a longitudinal direction.

In a seventh aspect of the invention, the header fitting body includes tapered portions at both ends in the longitudinal direction, and the opposite surface is formed between the tapered portion and the portion where the header terminals are provided in the header fitting body.

In an eighth aspect of the invention, a protrusion piece protruding toward the protrusion is provided in a portion in the sidewall surface on the outer side of the header fitting body that correspond to the protrusion.

In a ninth aspect of the invention, the protrusion piece is made of elastic metal.

In a tenth aspect of the invention, the protrusion piece is press-fitted and held in the header fitting body.

In an eleventh aspect of the invention, the protrusion piece is press-fitted from the side opposite to the side fitted to the socket fitting body of the header fitting body.

In a twelfth aspect of the invention, the protrusion pieces are press-fitted from the both ends of the header fitting body in the longitudinal direction.

In a thirteenth aspect of the invention, two of the protrusion pieces are connected by a bridging portion.

In a fourteenth aspect of the invention, the bridging portion includes a recess that is formed on the opposite side to a side fitted to the socket fitting body of the header fitting body with the protrusion pieces held by the header fitting body.

In a fifteenth aspect of the invention, a recessed portion and a protruded portion are, respectively, formed inside the sidewall surface on the inner side in the socket fitting body and inside the sidewall surface on the outer side in the header fitting body, the recessed portion and protruded portion being fitted to each other.

A sixteenth aspect of the invention is a header to be used in the aforementioned connector.

A seventeenth aspect of the invention is a socket to be used in the aforementioned connector.

Advantageous Effects of Invention

According to the present invention, it is possible to provide a connector including a socket and a header which can be more easily fitted to each other and to provide the header and socket to be used in the connector.

DESCRIPTION OF EMBODIMENTS

Hereinafter, a description is given in detail of an embodiment of the present invention with reference to the drawings. In the following description, the width direction (the short-side direction) of a connector is referred to as a direction X; the longitudinal direction of the connector, a direction Y; and the vertical direction of the connector in FIG. 9, a direction Z. Moreover, in the description of the socket and header, the upper side in the state illustrated in FIG. 9 is referred to as an upper side (front side) in the vertical direction, and the lower side is referred to as a lower side (back side) in the vertical direction.

Figure 9:
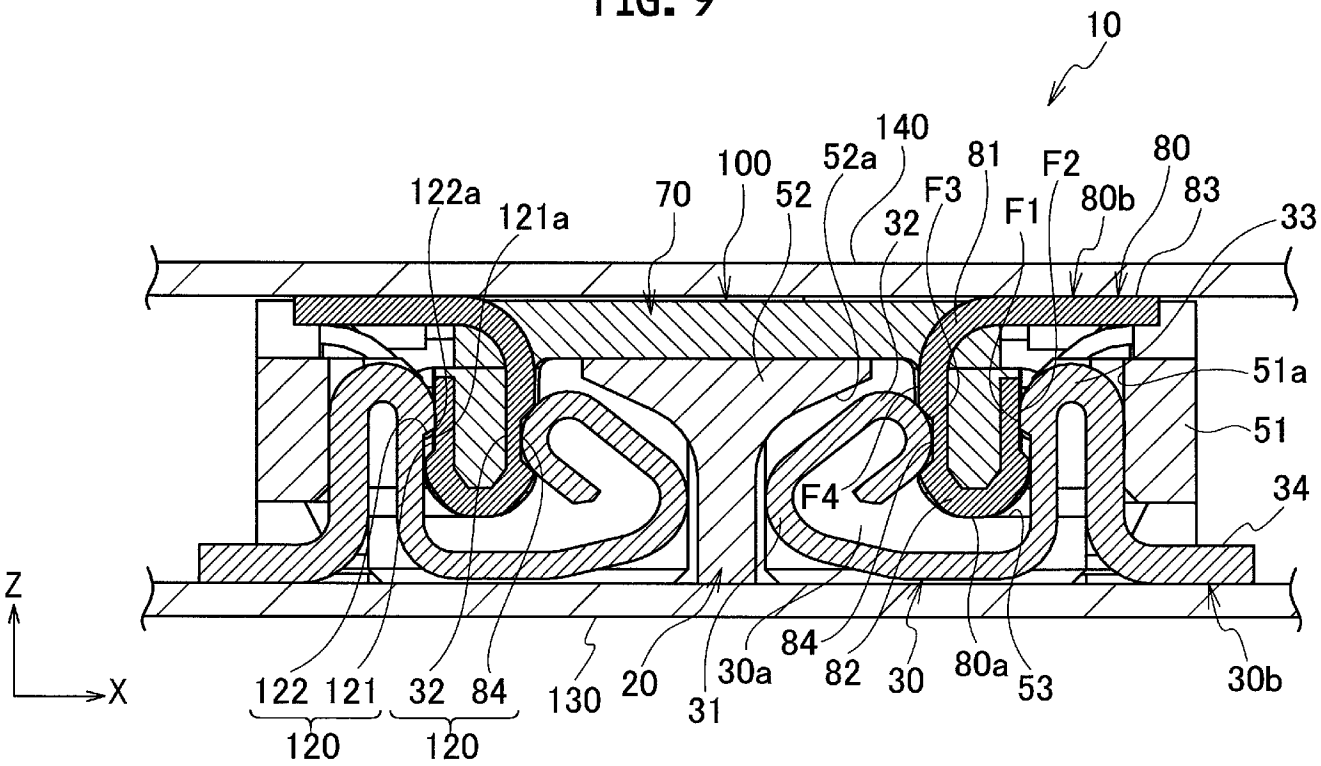
FIG. 9 is a cross-sectional view of the connector according to the embodiment of the present invention.
Figure 10:
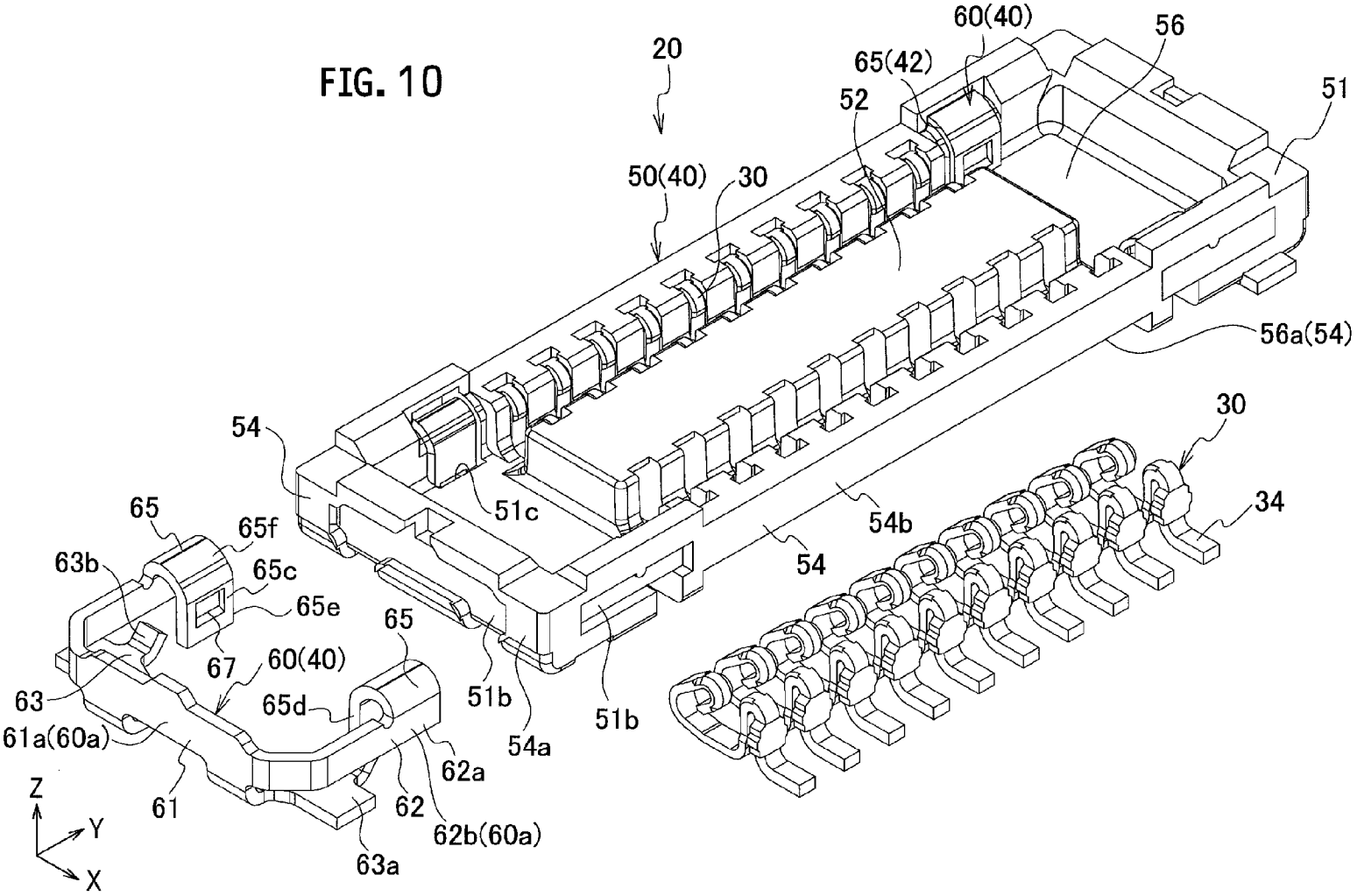
FIG. 10 is an exploded perspective view of the socket illustrated in FIG. 1, in which a socket holding bracket and socket terminals provided at one long side are detached.

A connector 10 according to the embodiment includes a socket 20 and a header 70, which are fitted to each other, as illustrated in FIG. 9. In this embodiment, the socket 20 has a socket fitting body 40 provided with socket terminals 30, and the header 70 has a header fitting body 90 provided with header terminals 80.

The socket fitting body 40 and header fitting body 90 are fitted to each other, thereby to bring the socket terminals 30 and header terminals 80 into contact with each other (see FIG. 9).

The socket 20 is attached to a first circuit substrate 130, and the header 70 is attached to a second circuit substrate 140.

Accordingly, when the socket 20 and header 70 are fitted to each other, the first circuit substrate 130 with the socket 20 attached thereto is electrically connected to the second circuit substrate 140 with the header 70 attached thereto.

Figure 1:
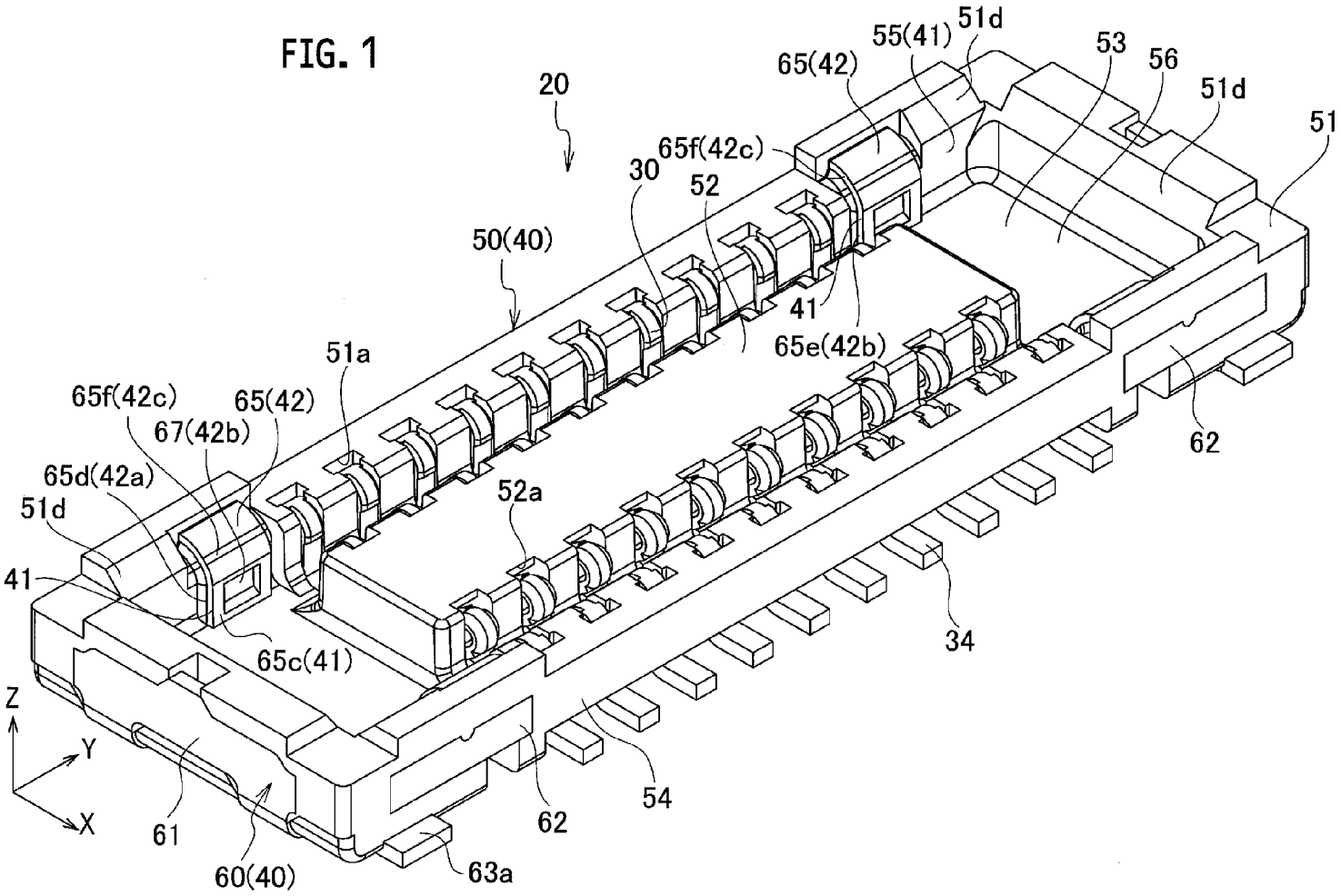
FIG. 1 is a perspective view illustrating a socket of a connector according to an embodiment of the present invention.
Figure 2:
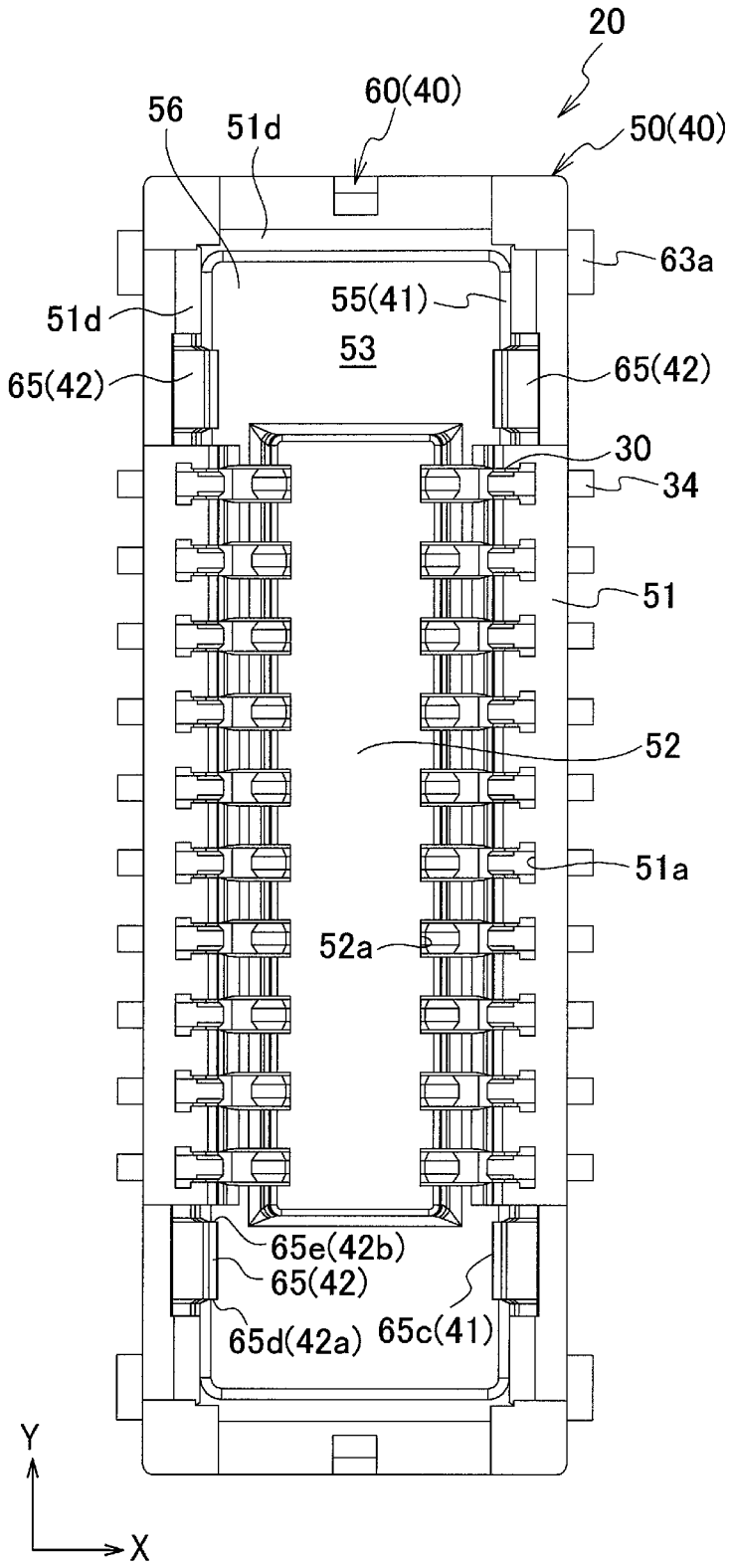
FIG. 2 is a plan view illustrating the socket of the connector according to the embodiment of the present invention.
Figure 3:
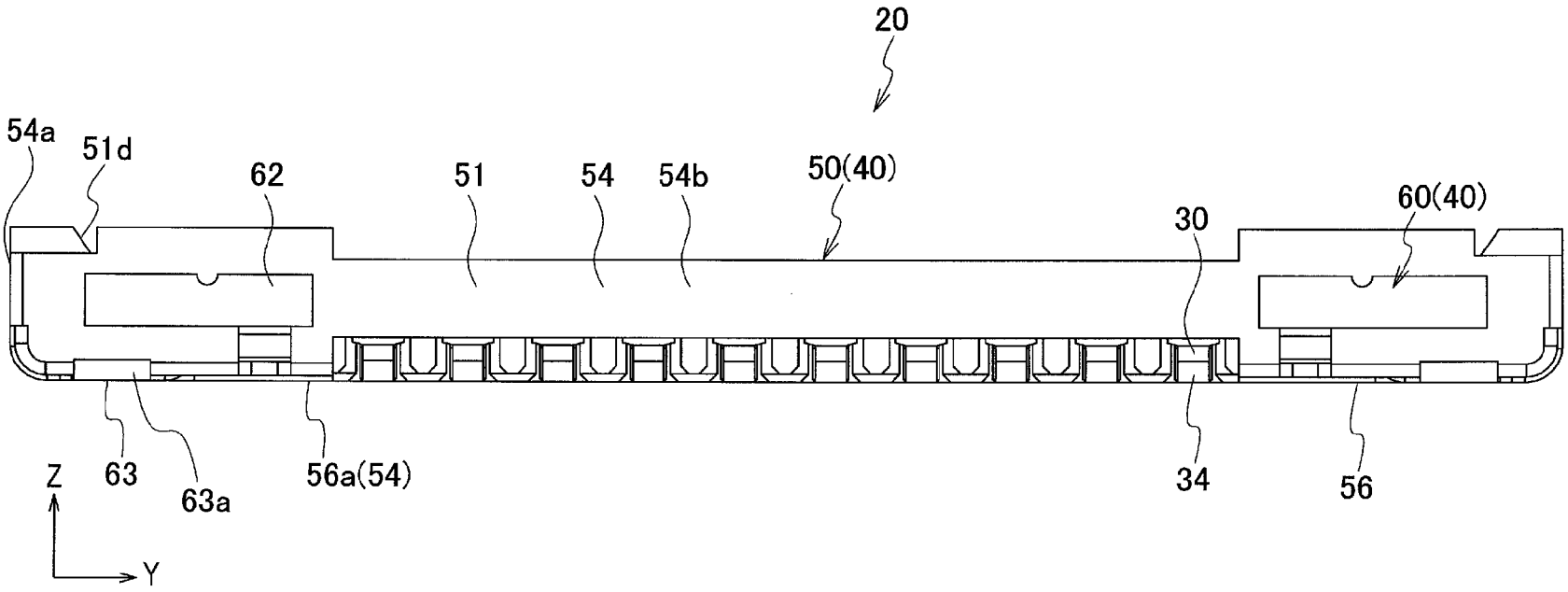
FIG. 3 is a side view illustrating the socket of the connector according to the embodiment of the present invention.
Figure 4:
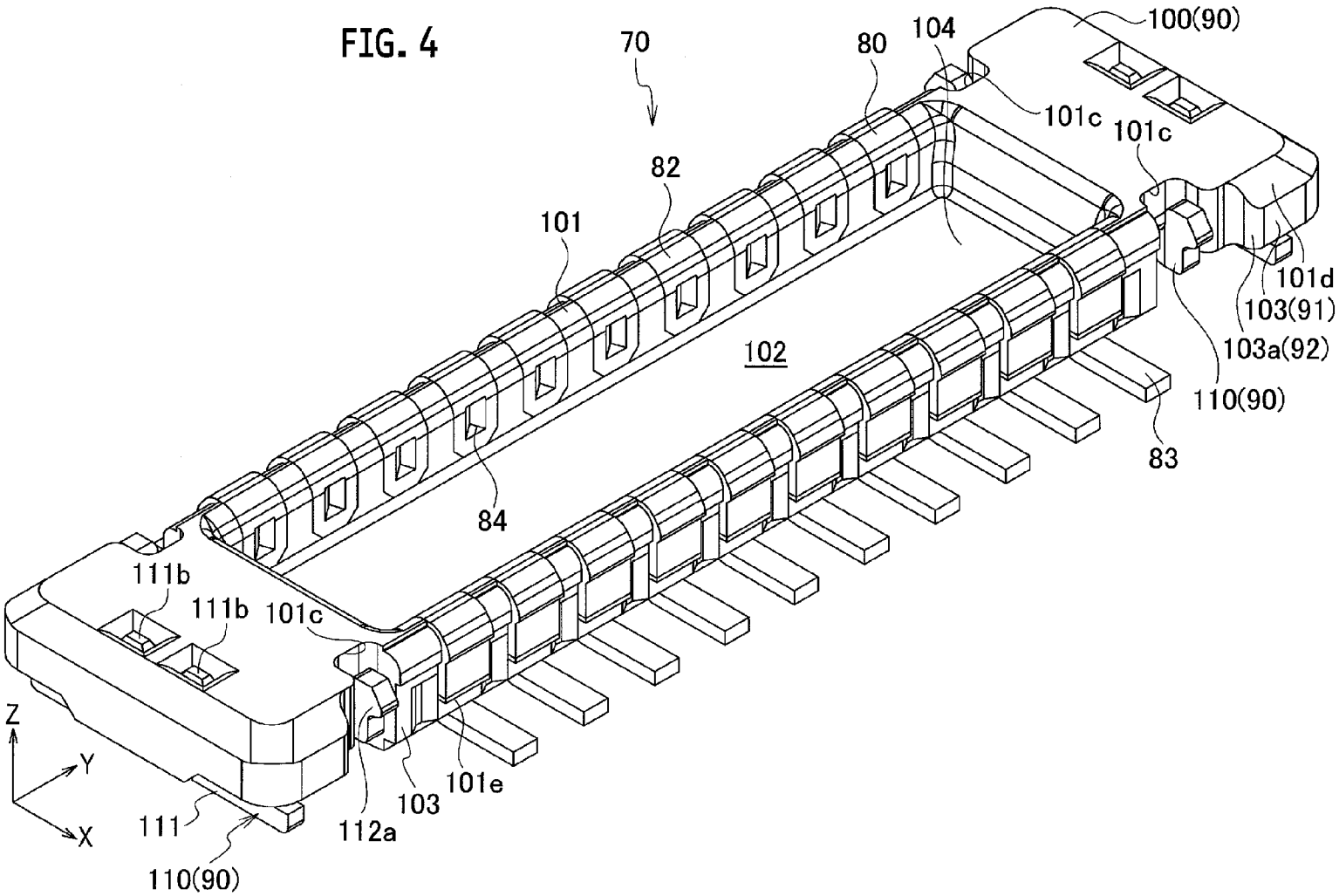
FIG. 4 is a perspective view illustrating the back side of a header of the connector according to the embodiment of the present invention.
Figure 5:
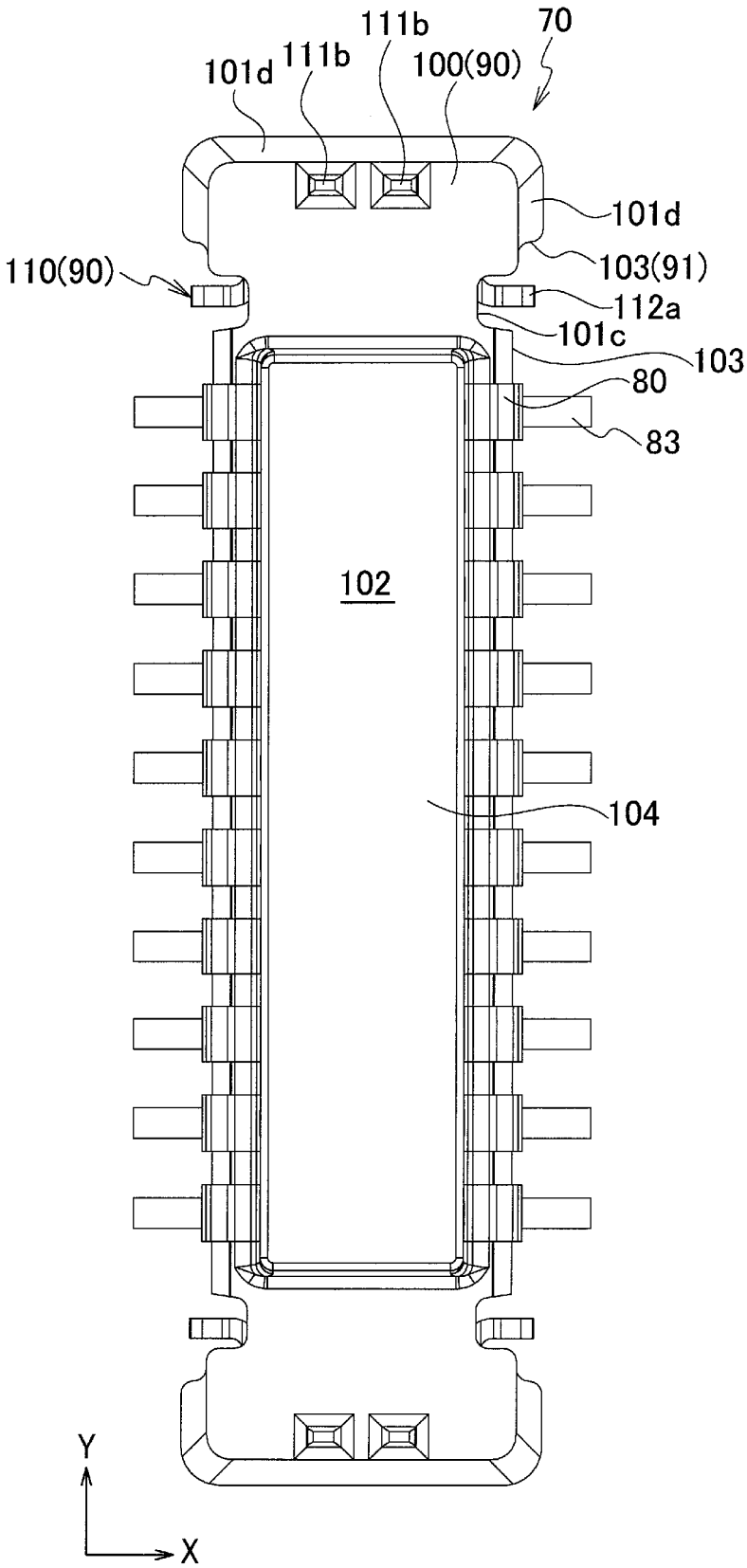
FIG. 5 is a back view illustrating the header of the connector according to the embodiment of the present invention.
Figure 6:
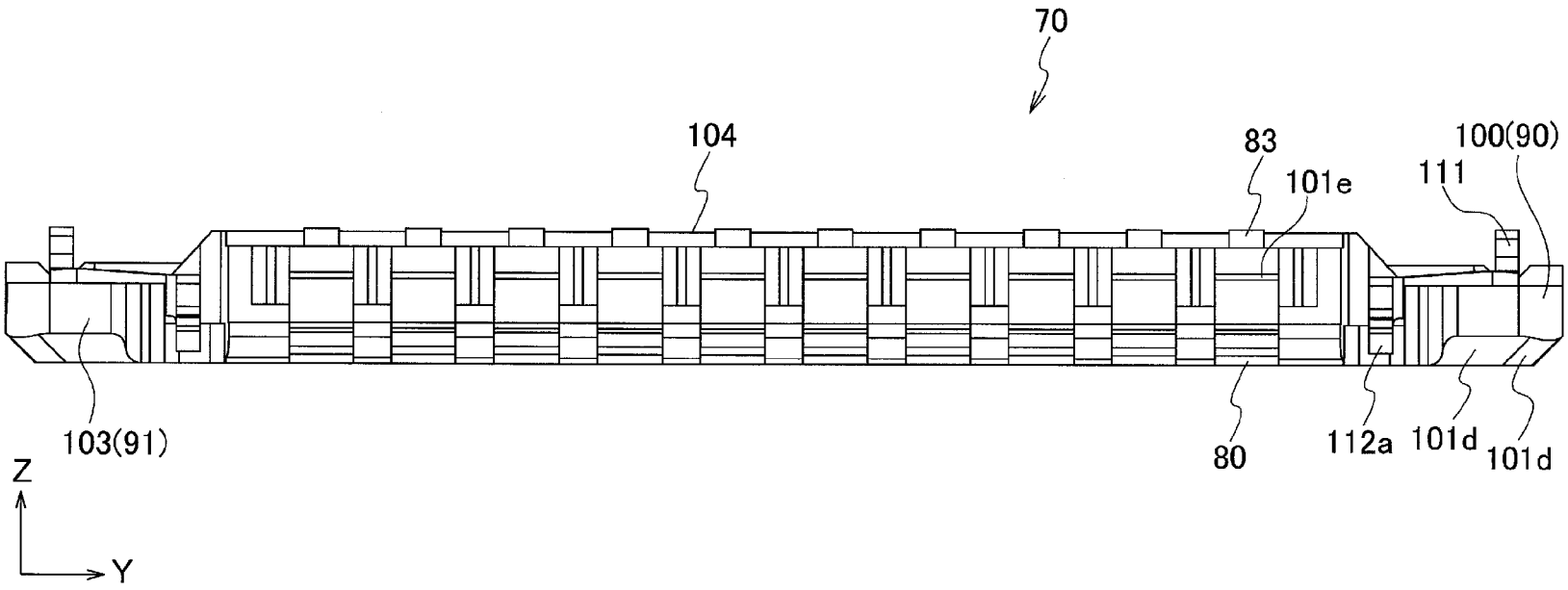
FIG. 6 is a side view illustrating the header of the connector according to the embodiment of the present invention.
Figure 7:
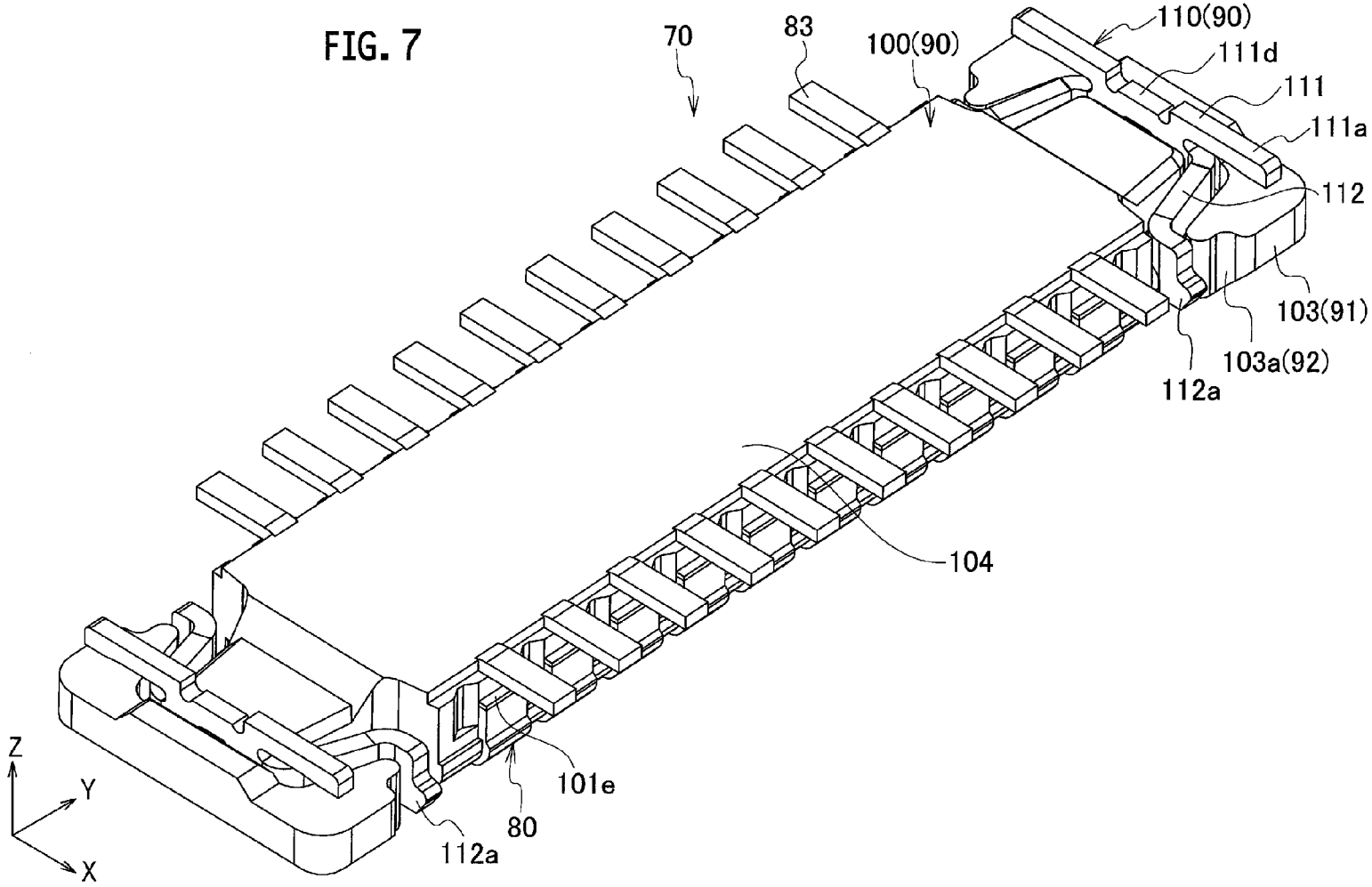
FIG. 7 is a perspective view illustrating the front side of the header of the connector according to the embodiment of the present invention.
Figure 8:
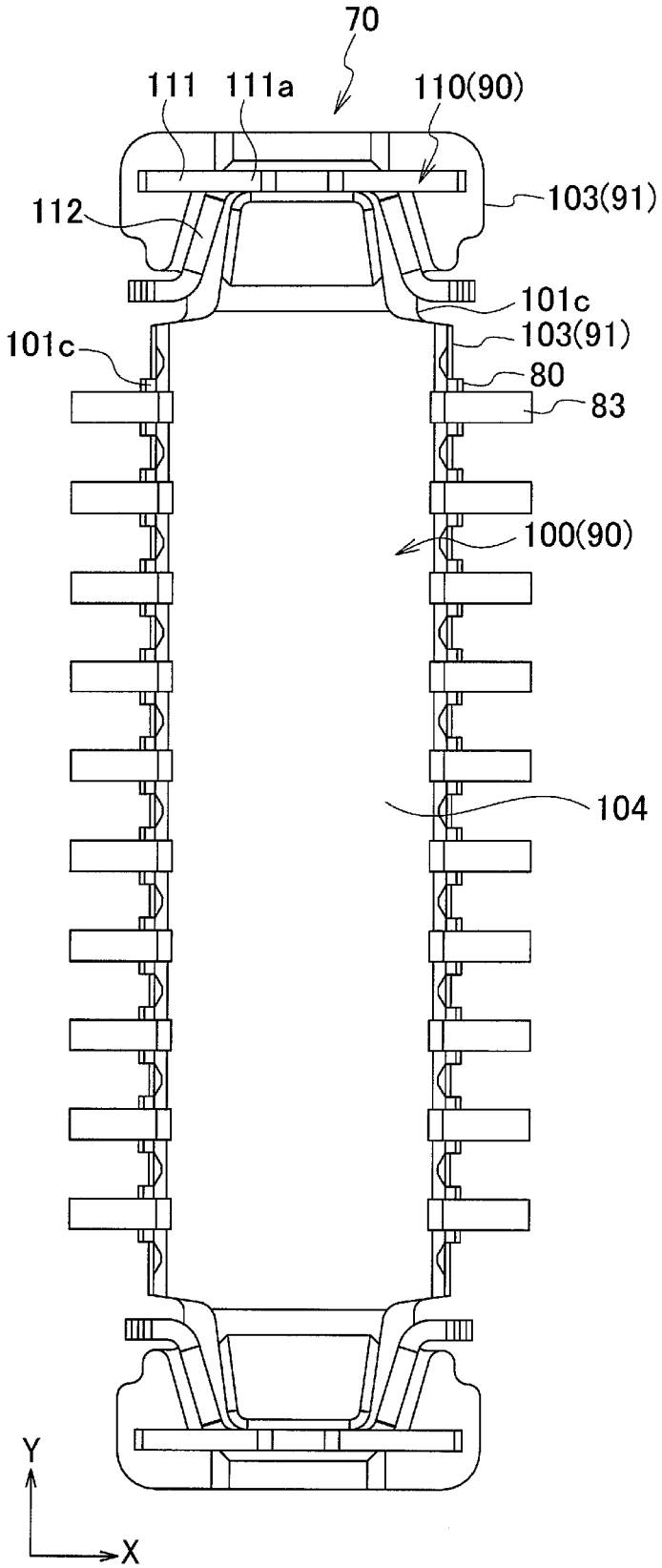
FIG. 8 is a plan view illustrating the header of the connector according to the embodiment of the present invention.

In the embodiment, as illustrated in FIGS. 1 to 3, the socket fitting body 40 includes a socket housing (socket body) 50, which is made of insulating synthetic resin and has a rectangular (oblong) shape in a planar view. The socket fitting body 40 further includes socket holding brackets 60 provided at both ends of the socket housing 50 in the longitudinal direction Y.

On the socket housing 50, plural socket terminals 30 are provided at predetermined intervals in the longitudinal direction Y along opposite long sides thereof. In other words, the plural socket terminals 30 are arranged on the two long sides of the socket housing 50 at predetermined intervals in the longitudinal direction Y.

The socket housing 50 includes a plate-shaped wall portion 56 and a circumferential wall portion 51 which is continuously provided along the edge of the wall portion 56 in a substantially rectangular ring shape and has a substantially box shape opened to one side (to the upper side). Furthermore, in the embodiment, a substantially rectangular island portion 52 is provided in the center of the plate-shaped wall portion 56 with a predetermined space from the circumferential wall portion 51. Between the circumferential wall portion 51 and island portion 52, a fitting recess portion 53, which is used for fitting of the header 70, is provided.

In the embodiment, furthermore, tapered portions 51*d* are provided at the upper inner edge of the circumferential wall portion 51. The taper portions 51*d* are inclined downward (toward the plate-shaped wall portion 56) toward the inside. The tapered portions 51*d* are formed on the short sides of the circumferential wall portion 51 and at both ends of each long side in the longitudinal direction. The tapered portions 51*d* are also formed between the adjacent socket terminals 30 and between the socket terminals 30 and the socket holding brackets 60 in the circumferential wall portion 51. In this embodiment, the tapered portions 51*d* are formed over the substantially entire circumference of the circumferential wall portion 51 as described above.

Each of the socket terminals 30 can be formed by bending a metallic band material having a predetermined thickness, for example. As illustrated in FIG. 9, a distal end portion 30*a* of the socket terminal 30 includes a second bent portion 32, in which the distal end portion bent and extended upward from a first bent portion 31 is bent inward. A proximal end portion 30*b* includes a third bent portion 33 bent in an inverted U-shape. The proximal end side of the third bent portion 33 constitutes a flat connection terminal portion 34.

In this embodiment, as illustrated in FIGS. 1 to 3 and 9, each socket terminal 30 is attached to the socket housing 50 so that the second bent portion 32 protrudes into the fitting recess portion 53. Herein, the third bent portion 33 is fitted into a recess portion 51*a* formed within the circumferential wall portion 51, and the first bent portion 31 is fitted in a recess portion 52*a* formed inside (in the lower surface side of) the island portion 52. In this state, the connection terminal portions 34 of the socket terminals 30 protrude from the foot (the lower end) of the circumferential wall portion 51 outward in the direction X (the width direction) and are connected to conductor patterns (terminals) of the first circuit substrate 130 by soldering or the like. In this embodiment, the socket terminals 30 are attached to the socket housing 50 (socket fitting body 40) by insert molding, press fitting, or the like.

On the other hand, as illustrated in FIGS. 4 to 8, the header fitting body 90 includes a header housing (header body) 100 which is made of an insulating synthetic resin and is molded so as to be rectangular (oblong) in a planar view as a whole. The header fitting body 90 includes header holding brackets 110, which are provided at both ends of the header housing 100 in the longitudinal direction Y. In the header housing 100, plural header terminals 80 are provided along the opposite long sides at the same intervals as those of the socket terminals 30 in the longitudinal direction Y. In other words, the plural header terminals 80 are provided on the two long sides of the header housing 100 at the predetermined intervals in the longitudinal direction Y.

The header housing 100 includes a plate-shaped wall portion 104 and a circumferential wall portion 101 continuously formed along the edge of the wall portion 104 in a substantially rectangular ring shape and has a substantially box shape opened to one side (to the lower side). Within the circumferential wall portion 101, a recessed portion 102 (see FIG. 4) is formed. Tapered portions 101*d* are formed at the lower outer edge of the circumferential wall portion 101. The tapered portions 101*d* are inclined upward (toward the plate-shaped wall portion 104) toward the outside. The tapered portions 101*d* are provided at short sides of the circumferential wall portion 101 and at both ends of each long side thereof in the longitudinal direction. The portions between the adjacent socket terminals 30 and between the socket terminals 30 and the socket holding brackets 60 in the circumferential wall portion 101 are, respectively, bent in an R-shape (an inverted U-shape).

Each of the header terminals 80 can be formed by bending a metallic band material having a predetermined thickness similarly to the socket terminals 30. A distal end portion 80*a* of each header terminal 80 includes a fifth bent portion 82, in which the distal end portion extended upward from a fourth bent portion 81 is folded back into an inverted U shape, while a proximal end portion 80*b* includes a substantially flat connection terminal portion 83.

Each header terminal 80 is provided for the header housing 100 so that the fifth bent portion 82 is positioned so as to cover the end portion (the lower part in FIG. 9) curved in an R-shape in the circumferential wall portion 101 and the proximal end portion 80*b* penetrates the foot (the upper side in FIG. 9) of the circumferential wall portion 101. In this embodiment, the header terminals 80 are provided for the header housing 100 by insert molding. In this state, the connection terminal portions 83 of the header terminals 80 protrude from the lower end of the circumferential wall portion 101 outward in the direction X (the width direction) and are connected to conductor patterns (terminals) of the second circuit substrate 140 by soldering. Furthermore, a protruding wall portion 101*e* for positioning the outer end of each head terminal 80 is protruded outward on the outer circumference of the circumferential wall portion 101 (see FIG. 4) in this embodiment. The header terminals 80 may be provided for the header housing 100 (the header fitting body 90) by press-fitting the header terminals 80 to the header housing 100.

As illustrated in FIG. 9, the header 70 is fitted to the socket 20 by inserting and fitting the circumferential wall portion 101 of the header housing 100 into the fitting recess portion 53 of the socket housing 50. Accordingly, in this embodiment, one side (the upper side; the opening side) of the socket housing 50 corresponds to the side fitted to the header fitting body 90 of the socket fitting body 40, and the plate-shaped wall portion 56 is provided at the side opposite to the side which is fitted to the header fitting body 90 of the socket fitting body 40 (the other side of the socket housing 50; the lower side). On the other hand, one side (the lower side; the opening side) of the header housing 100 corresponds to the side fitted to the socket fitting body 40 of the header fitting body 90.

In the process of fitting the header 70 to the socket 20, the tapered portions 51*d* and tapered portions 101*d* that are formed at the long sides located at one side in the direction X (the width direction; the short side direction) are laid on each other, and the header 70 is then moved toward the other side in the direction X (the width direction; the short-side direction) to be fitted to the socket 20. Then, the tapered portions 51*d* and 101*d* can function as a guide portion, so that the header 70 can be fitted to the socket 20 more easily.

In a state where the header 70 is fitted to the socket 20, an outside surface F1 on the distal end portion 30*a* side of the third bent portion 33 in each socket terminal 30 is in resilient contact with an outside surface F2 on the distal end portion 80*a* side of the fifth bent portion 82 in each header terminal 80. On the other hand, an outside surface F3 of the second bent portion 32 of the socket terminal 30 is in resilient contact with an outside surface F4 between the fourth and fifth bent portions 81 and 82 in the header terminal 80. The socket terminal 30 and the header terminal 80 are thus electrically connected, and the conductor patterns of the first circuit substrate 130 and the conductor patterns of the second circuit substrate 140 are eventually electrically connected to each other.

Moreover, the socket terminals 30 and header terminals 80 of this embodiment are provided with lock mechanisms 120 which engage the socket and header terminals 30 and 80 with each other to keep the connection of the socket 20 and header 70.

To be specific, a first step portion 121 formed in the outside surface F2 of each header terminal 80 and a second step portion 122 formed in the outside surface F1 of the corresponding socket terminal 30 constitute one of the lock mechanisms 120 on the outside in the direction X (the width direction).

In this embodiment, the first step portion 121, which includes an inclined step surface 121*a*, is provided such that the header terminal 80 is made thin at a part of the outside surface F2 which is above the surface in contact with the socket 30. On the other hand, the second step portion 122, which includes an inclined step surface 122*b*, is provided such that the socket terminal 30 is made thin at a part of the outside surface F1 which is below the surface in contact with the header terminal 80.

In this embodiment, furthermore, the lock mechanism 120 is also formed inside in the direction X (the width direction) such that an engagement recessed portion 84 is formed in the outside surface F4 between the fourth and fifth bent portions 81 and 82 of the header terminal 80, and is engaged with the second bent portion 32 of the socket terminal 30.

Accordingly, in the process of fitting the header 70 to the socket 20, the outside surfaces F2 and F4 of the header terminal 80 are inserted while pushing apart the outside surfaces F1 and F3 of the socket terminal 30 against the elastic force. The first step portion 121 then gets over the second step portion 122, and the second bent portion 32 of the socket terminal 30 is engaged with the engagement recessed portion 84, thus fitting the header 70 to the socket 20. In this process, the second bent portion 32 is engaged with the engagement recessed portion 84, and the step surface 121*a* of the first step portion 121 is engaged with the step surface 122*a* of the second step portion 122. The socket 20 and header 70 are thereby locked with each other to keep the connection therebetween.

On the other hand, for detaching the socket 20 from the header 70, the socket 20 and header 70 are pulled off each other in the detaching direction. The step surface 121*a* of the first step portion 121 and the step surface 122*a* of the second step portion 122 slide relatively to each other to push apart the outside surfaces of the socket terminal 30, thus disengaging the first and the second step portions 121 and 122 from each other. At this time, the engagement recessed portion 84 is also disengaged from the second bent portion 32. The socket 20 and header 70 can be then separated from each other.

As described above, the socket holding brackets 60 are provided at both ends of the socket housing 50 in the longitudinal direction Y while the header holding brackets 110 are provided at both ends of the header housing 100 in the longitudinal direction Y in this embodiment. The socket and header holding brackets 60 and 110 are, respectively, used to enhance the strength of the socket housing 50 and header housing 100 and to attach and fix attachment pieces 63*a* and 111*a* included in the same to the aforementioned circuit substrates.

The attachment pieces 63*a* of each socket holding bracket 60 are soldered to the first circuit substrate 130. The socket 20 can be then firmly joined to the first circuit substrate 130 together with the connection terminal portions 34 of the socket terminals 30 that are soldered to the first circuit substrate 130.

The attachment pieces 111*a* of each header holding bracket 110 are soldered to the second circuit substrate 140. The header 70 can be thereby firmly joined to the second circuit substrate 140 coupled with the connection terminal portions 83 of the socket terminals 80 that are soldered to the second circuit substrate 140.

According to the aforementioned configuration, the socket 20 and header 70, which are firmly joined to the respective circuit substrates, can be fitted to each other to bring the socket terminals 30 in contact with the respective header terminals 80 for electric continuity. The conductor patterns of the circuit substrates can be therefore electrically connected. Moreover, the connection between the socket 20 and header 70 can be firmly kept since the socket terminals 30 and header terminals 80 are provided with the lock mechanisms 120 as described above.

In this embodiment, each of the header holding brackets 110 includes protrusion pieces 112 which are movable relatively to a joint piece (a base portion) 111 in the width direction X of the connector 10, and each of the socket holding brackets 60 includes engagement recesses 67 which can be engaged with the respective protrusion pieces 112.

Each socket holding bracket 60 can be formed by press molding of a metallic plate having a predetermined thickness. Each socket holding bracket 60 includes: a side plate portion 61 extending in the width direction X of the connector 10; and bottom plate portions 63 extending at substantially right angles to the side plate portion 61 from both lower ends thereof toward the center in the longitudinal direction Y. The both ends of the bottom plate portions 63 are protruded outside of the both sides in the width direction X of the connector 10 to form the attachment pieces 63*a*. Each bottom plate portion 63 includes an anchor portion 63*b* on the inside in the direction Y (longitudinal direction). The anchor portion 63*b* extends inward and upward to prevent the socket holding bracket 60 from falling off the socket housing 50. The shape and the protruding direction of the anchor portions can be varied. Alternatively, the anchor portions may be omitted.

At both ends of the side plate portion 61 in the width direction X, extension portions 62 are provided. The extension portions 62 extend from the both ends of the side plate portion 61 in the width direction X toward the center in the longitudinal direction Y of the connector 10 at substantially right angles to the side plate portion 61. An extremity portion 62*a* of each extension portions 62 in the extending direction includes a substantially inverted U-shaped claw portion 65. Each of the engagement recesses 67 is provided on an end portion 65*a* side (on the inner side in the direction X) in the claw portion 65. Furthermore, upper part of each claw portion 65 includes an inclined portion 65*f*. The inclined portion 65*f* is inclined downward such that the inside in the direction X (the width direction) becomes lower.

The thus-configured socket holding brackets 60 are attached to respective engagement recess portions 51*b*, which are formed at both ends of the socket housing 50 in the longitudinal direction Y. Specifically, the socket holding brackets 60 are attached to the engagement recess portions 51*b* by press-fitting thereof into the socket housing 50, insert molding, or the like. Each engagement recess portion 51*b* has such a depth that an outer wall surface 54 of the circumferential wall portion 51 and the outer wall surface 60*a* of the socket holding bracket 60 are substantially flush with each other. In other words, the socket holding bracket 60 is integrally molded in the socket housing 50 so that the outer wall surface 60*a* of the socket holding bracket 60 may be exposed substantially flush with the outer wall surface 54 of the circumferential wall portion 51. In this embodiment, the outside surface 61*a* of the side plate portion 61 is exposed flush with the outer side surface (the end surface in the longitudinal direction) 54*a* extending at the outermost end of the socket housing 50 in the direction Y (the longitudinal direction). Moreover, the outside surfaces 62*b* of the extension portions 62 are exposed flush with the respective outer side surfaces (the end surfaces in the short-side direction) extending at the outermost ends in the direction X (the width direction; the short-side direction). Furthermore, an outside surface 63*b* of each bottom plate portion 63 is exposed flush with a bottom surface 56*a* (the outer wall surface 54) of the socket housing 50. The outer wall surface 60*a* of each socket holding bracket 60 does not need to be exposed in the outer wall surface 54 of the circumferential wall portion 51. Even if the outer wall surface 60*a* is exposed, the outer wall surface 60*a* does not need to be exposed flush with the outer wall surface 54 of the circumferential wall portion 51.

The socket housing 50 includes recess portions 51*c* which are formed at positions corresponding to the end portions 65*a* of the claw portions 65 so as to be connected to the fitting recess portion 53. Specifically, the socket housing 50 is recessed so as to have two steps at each of the positions corresponding to the end portions 65*a* of the claw portions 65 and is molded with the end portions 65*a* of the claw portions 65 fitted in the respective recess portions 51*c*.

In such a manner, the engagement recesses 67 of the socket holding brackets 60 are provided at totally four places at both ends in the longitudinal direction Y, of the pair of long sides of the connector 10 so as to be arranged side by side with the socket terminals 30.

Figure 11:
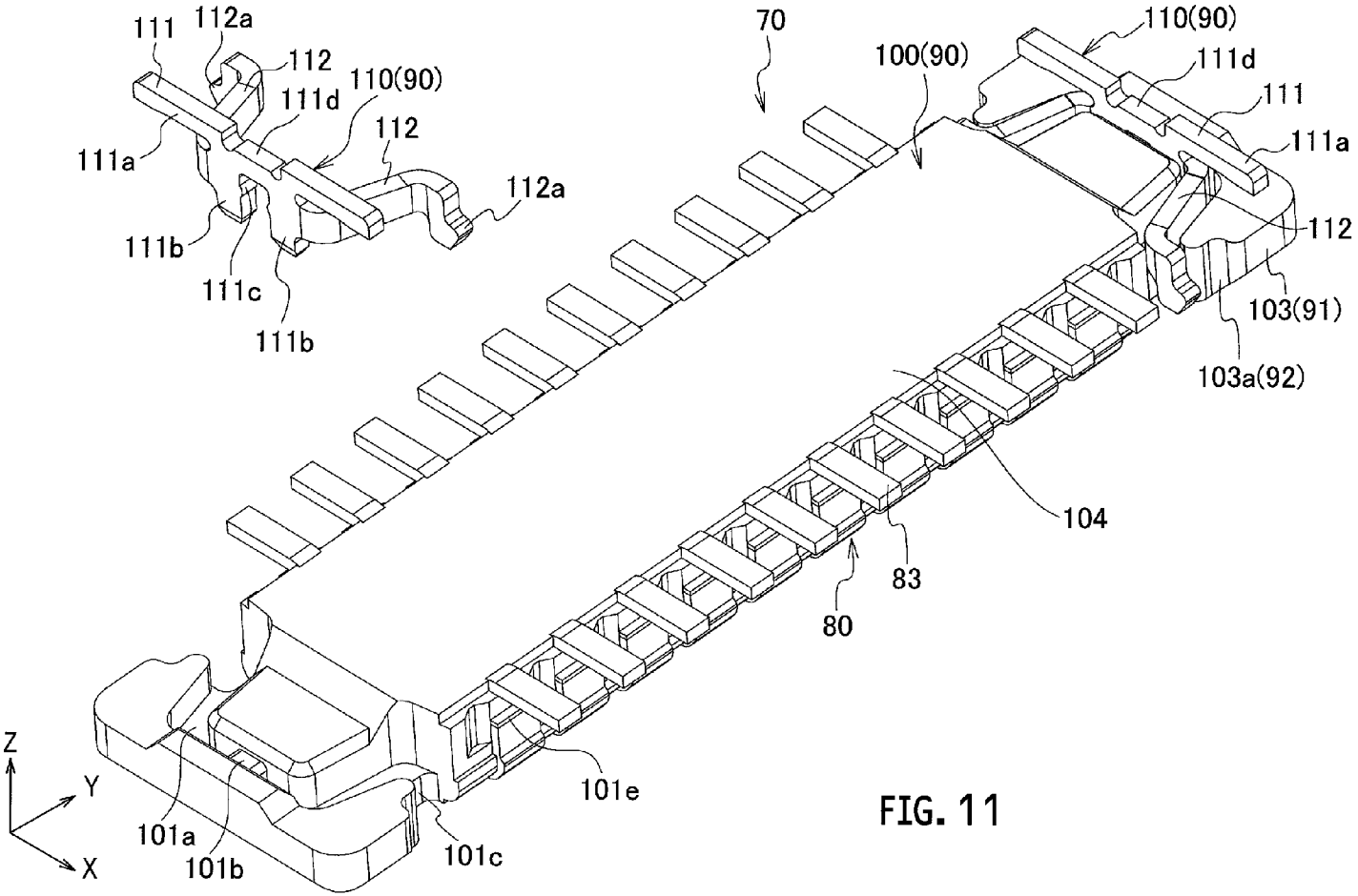
FIG. 11 is an exploded perspective view of the header illustrated in FIG. 7 with a header holding bracket detached.

On the other hand, each header holding bracket 110 can be formed by press-molding a metallic plate having a predetermined thickness in a similar manner to the socket holding brackets 60. As illustrated in FIG. 11, each header holding bracket 110 of the embodiment includes: a joint piece (a base portion) 111; and a pair of protrusion pieces 112 and 112 which protrude from the joint piece 111 to form a substantially inverted V shape (to be more specific, substantially a shape of an inverted V with the top separated).

The joint piece 111 includes: an attachment piece 111*a* which is located at an upper position in the vertical direction Z when the joint piece 111 is attached to the header housing 100; and a pair of branch pieces 111*b* which are branched in a fork downward from the attachment piece 111*a* extending in the width direction X. While the attachment piece 111*a* is used to attach and fix the header 70 to the above-described second circuit substrate 140, the pair of branch pieces 111*b* are provided with step-like protrusions 111*c* on the respective surfaces facing each other.

The thus-configured header holding brackets 110 are fitted to the respective engagement recess portions 101*a* formed at both ends of the header housing 100 in the longitudinal direction Y. In the engagement recess portion 101*a*, a central inner wall portion 101*b* which corresponds to the aforementioned protrusions 111*c* includes a pair of steps (not shown). The header holding bracket 110 is fitted into the engagement recess portion 101*a* by pushing the header holding bracket 110 to cause the protrusions 111*c* to get over the respective steps (not shown). The central inner wall portion 101*b* may be configured to not include the pair of steps. In this case, the central inner wall portion 101*b* may be dented and held by the protrusions 111*c*.

The engagement recess portions 101*a* are recessed into the substantially same shape as the respective header holding brackets 110. The engagement recess portions 101*a* have such a depth that each attachment piece 111*a* extends substantially flush with the connection terminal portions 83 of the header terminals 80 with the header holding brackets 110 fitted to the header 70. Accordingly, the upper surfaces (the front surfaces: the surfaces which are connected to the second circuit substrate 140) of the attachment pieces 111*a* are flush with the upper surfaces (the front surfaces: the surfaces which are connected to the second circuit substrate 140) of the connection terminal portions 83. This can facilitate soldering of the second circuit substrate 140 to the attachment pieces 111*a* and connection terminal portions 83.

Figure 12:
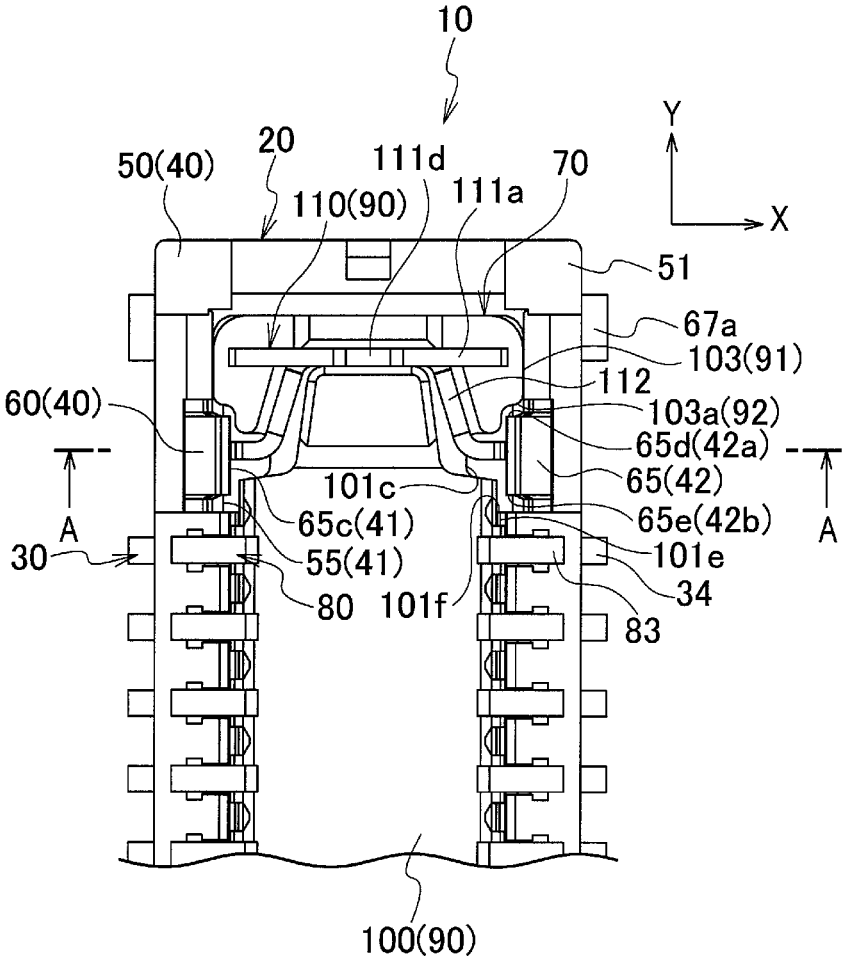
FIG. 12 is a plan view illustrating a main portion of the connector according to the embodiment of the present invention.
Figure 13:
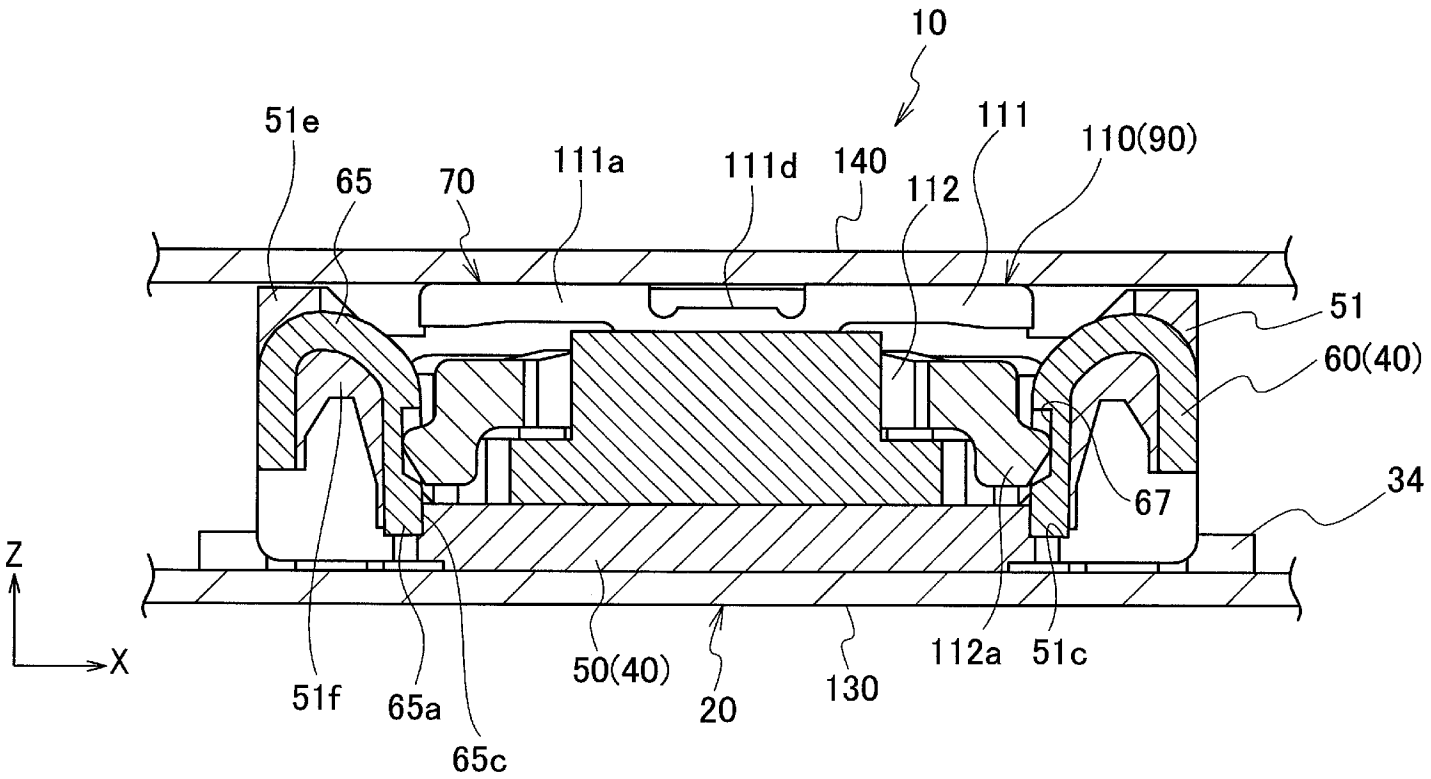
FIG. 13 is a cross-sectional view taken along a line A-A of FIG. 12.
Figure 14:
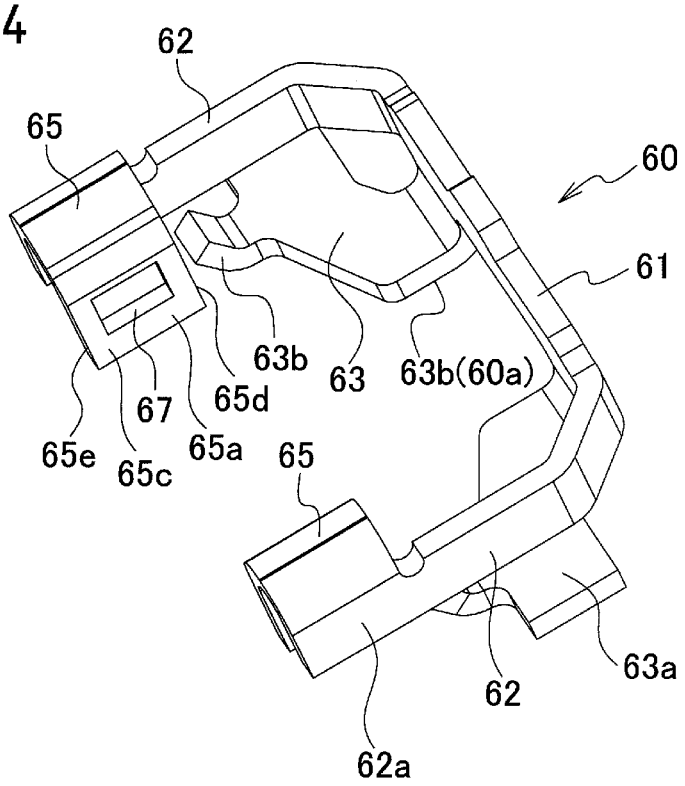
FIG. 14 is a perspective view illustrating the socket holding bracket according to the embodiment of the present invention.
Figure 15:
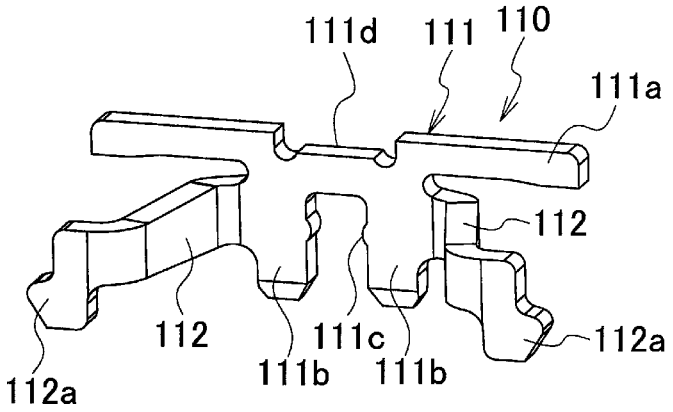
FIG. 15 is a perspective view illustrating the header holding bracket according to the embodiment of the present invention.

In this embodiment, as illustrated in FIGS. 12 and 13, when the header 70 is fitted to the socket 20, the protrusion pieces 112 of the header holding brackets 110 are inserted into the respective engagement recesses 67 of the socket holding brackets 60.

Specifically, the end portions 112*a* of the protrusion pieces 112 have such dimensions as to slightly protrude outward in the width direction X from the respective outer wall inside surfaces 65*c* of the claw portions 65 of the socket holding brackets 60. The pair of protrusion pieces 112 are elastically deformed (relatively moved), and the end portions 112*a* are pressed close to each other by the outer wall inside surfaces 65*c* of the claw portions 65 while sliding to the respective engagement recesses 67. The end portions 112*a* of the protrusion pieces 112 are restored to the original state within the engagement recesses 67 by the resilience force to be fitted to the respective engagement recesses 67.

According to the connector 10 of the embodiment, as described above, when the socket 20 and header 70 are moved in the detaching direction (a direction that the socket 20 and header 70 are separated from each other in the vertical direction Z), the protrusion pieces 112 and engagement recesses 67 can be locked with each other. This can increase the fitting force between the socket 20 and header 70 and can make it difficult for the socket 20 and header 70 to be detached from each other.

In this embodiment, each header holding bracket 110 includes the protrusion pieces 112, which can move relatively to the joint piece (base portion) 111 in the width direction X of the connector 10, and each socket holding bracket 60 includes the engagement recesses 67 which can be locked with the protrusion pieces 112. Accordingly, in the process of fitting the socket 20 to the header 70, the protrusion pieces 112 can be fitted into the respective engagement recesses 67, thus providing good fitting feeling. Moreover, if the socket 20 and header 70 try to move in the detachment direction, the header holding brackets 110 are locked with the engagement recess portion 67, thus making it difficult for the fitted socket 20 and header 70 to be detached from each other.

Since the protrusion pieces 112 are stretchable (elastically deformable) in the width direction X of the connector 10 in particular, the resilient force of the protrusion pieces 112 can be used to improve the fitting feeling.

Moreover, the engagement recesses 67 of the socket holding brackets 60 are arranged in a line of the socket terminals 30. Accordingly, the space near the socket terminals 30 can be used to arrange the engagement recesses 67 at four corners of the socket housing 50. This can make it difficult for the socket 20 and header 70 fitted to each other to be detached from each other, coupled with the engagement of the protrusion pieces 112 with the engagement recesses 67.

Moreover, each socket holding bracket 60 includes the substantially inverted U shaped claw portions 65, which are arranged so as to penetrate an upper end portion 51*e* of the circumferential wall portion 51 of the socket housing 50 and cover a top portion 51*f* of the circumferential wall portion 51. The claw portions 65 are provided with the respective engagement recesses 67. Accordingly, in the process of attaching the socket holding brackets 60 to the socket housing 50, the substantially inverted U shaped claw portions 65 are fitted to the circumferential wall portion 51 of the socket housing 50 from above. This can increase the rigidity and firmly attach the socket holding brackets 60 to the socket housing 50. Furthermore, the provision of the claw portions 65 can facilitate forming of the engagement recesses 67 so as to face the respective protrusion pieces 112. As described above, the socket holding brackets 60 may be formed by insert molding in the socket housing.

Herein, the socket 20 and header 70 can be easily fitted to each other in this embodiment.

Specifically, at least one of an inner sidewall surface (the sidewall surface on the inner side) 41 of the socket fitting body 40 and an outer wall surface (the sidewall surface on the outer side) of the header fitting body 90 includes a protrusion. The inner sidewall surface (the sidewall surface on the inner side) 41 of the socket fitting body 40 and the outer wall surface (the sidewall surface on the outer side) of the header fitting body 90 are sidewall surfaces that face to each other when the socket fitting body 40 is fitted to the header fitting body 90.

At least one of the both side surfaces of one of the socket and header fitting bodies 40 and 90 in the width direction includes at least one protrusion that faces an opposite surface formed in the sidewall surface of the other body when the socket and header fitting body 40 and 90 are fitted each other.

In this embodiment, the socket fitting body 40 includes the socket housing 50 and the socket holding brackets 60. An inner side surface 55 of the socket housing 50 and the exposed surfaces of the claw portions 65 exposed to the inner side of the socket holding brackets 60 constitute the inner sidewall surface 41.

The claw portions 65 are positioned so as to protrude inward from the inner side surface 55 around the same to form protrusions 42. In other words, the protrusions 42 (the claw portions 65) are formed in the inner sidewall surface (the sidewall surface on the inner side) 41 of the socket fitting body 40 in this embodiment.

The protrusions 42 are formed at four corners of the rectangular socket fitting body 40 in this embodiment. To be more specific, the protrusions 42 are formed at two pairs of diagonal portions of the rectangular socket fitting body 40.

In other words, the four protrusions 42 formed in the inner sidewall surface (the sidewall surface on the inner side) 41 include two (at least one) pairs of protrusions 42 formed at positions point-symmetric about the center of the socket fitting body 40 in a planar view in this embodiment.

The protrusions 42 are formed at both ends of the socket fitting body 40 in the direction Y (the longitudinal direction) in this embodiment. Specifically, the protrusions 42 are formed at both ends in the direction Y, of each of the pair of long sides of the socket fitting body 40 so as to protrude inward in the direction X (the width direction) in this embodiment. The width direction of the protrusions 42, therefore, substantially coincides with the direction Y (the longitudinal direction) in this embodiment.

In the inner sidewall surface (the sidewall surface on the inner side) 41 of the socket fitting body 40, the protrusions 42 are provided from the vicinity of the end on the side fitted to the header fitting body 90 to the vicinity of the plate-shaped wall portion 56 in this embodiment. In other words, each protrusion 42 is formed from one side (the upper side; the opening side) of the fitting recess portion 53 to the other side thereof (the lower side; the plate-shaped wall portion 56 side) in the socket fitting body 40 so as to protrude inward in the direction X (the width direction). The protrusions 42 do not need to protrude in the range from the vicinity of the end on the side that is fitted to the header fitting body 90 to the vicinity of the plate-shaped wall portion 56 in the inner sidewall surface (the sidewall surface on the inner side) 41 of the socket fitting body 40. Moreover, it may be configured that only some of the plural protrusions 42 are provided so as to protrude in the range from the vicinity of the end on the side that is fitted to the header fitting body 90 to the vicinity of the plate-shaped wall portion 56 in the inner sidewall surface (the sidewall surface on the inner side) 41 of the socket fitting body 40.

Furthermore, the upper side (on the side of the socket fitting body 40 that is fitted to the header fitting body 90) of each protrusion 42 includes an inclined portion 42*c*. In this embodiment, the inclined portions 65*f* of the claw portions 65 correspond to the inclined portions 42*c*. The outer and inner side surfaces 65*d* and 65*e* of each claw portion 65 correspond to the both side surfaces 42*a* and 42*b* of each protrusion 42 in the width direction. In this embodiment, the portion of the circumferential wall portion 51 where each claw portion 65 is formed (the portion in which the top portion 51*f* is formed) also protrudes inward, and the both sidewalls thereof are exposed in the direction Y (the longitudinal direction). Accordingly, the outer and inner side surfaces 65*d* and 65*e* constitute parts of side surfaces 42*a* and 42*b* in the width direction, respectively.

In this embodiment, the claw portions 65 of the socket holding brackets 60 made of metal are the protrusions 42, and the protrusions 42 are, therefore, made of metal.

On the other hand, opposite surfaces 92 are formed in the respective portions corresponding to the protrusions 42 in the outer sidewall surface (the sidewall surface on the outer side) 91 of the header fitting body 90. The header fitting body 90 includes the header housing 100 and the header holding brackets 110 in this embodiment. The outer sidewall surface (the sidewall surface on the outer side) 91 includes an outer side surface 103 of the header housing 100 and exposed surfaces of the header holding brackets 110 exposed to the outer circumference.

Opposite surfaces 103*a* as the opposite surfaces 92 are formed in the portions of the outer side surface 103 that correspond to the protrusions 42 with the socket and header fitting bodies 40 and 90 fitted to each other.

Specifically, the opposite surfaces 103*a* are formed at positions on the outside of the protrusions 42 in the direction Y (the longitudinal direction) so as to face the respective outer side surfaces 65*d* of the protrusions 42. In this embodiment, the opposite surfaces 103*a* are formed at the positions on the outside of the respective protrusions 42 in the direction Y (the longitudinal direction) so as to face the respective outer side surfaces 65*d* of the four protrusions 42.

As described above, the four opposite surfaces 103*a* are formed in the outer side surface 103 so as to include two pairs (at least one pair) of opposite surfaces 103*a* which are formed at positions point-symmetric about the center of the header fitting body 90 in a planar view in this embodiment.

The header fitting body 90 is rectangular in this embodiment. The opposite surfaces 103*a* are formed at both ends of the header fitting body 90 in the direction Y (the longitudinal direction).

Moreover, each opposite surface 103*a* (opposite surface 92) is provided in a range from the vicinity of an end (the lower end) of the outer sidewall surface (the sidewall surface on the outer side) 91 of the header fitting body 90, on the side fitted to the socket fitting body 40, to the vicinity of the opposite end (upper end) of the outer sidewall surface (sidewall surface) 91. In other words, each opposite surface 103*a* is extended substantially all over the outer sidewall surface (the sidewall surface on the outer side) 91 of the header fitting body 90 in the vertical direction. In this embodiment, each opposite surface 103*a* is extended from the upper end to the lower end in the outer sidewall surface (the sidewall surface on the outer side) 91 of the header fitting body 90 entirely in the vertical direction. By extending the opposite surfaces 103*a* from the upper end to the lower end of the outer sidewall surface (the sidewall surface on the outer side) 91 of the header fitting boy 90 entirely in the vertical direction, the header fitting body 90 can be manufactured more easily.

The opposite surfaces 103*a* (opposite surfaces 92) do not need to be provided to extend from the vicinity of the end (the lower end) on the side that is fitted to the socket fitting body 40 to the vicinity of the opposite end (the upper end) in the outer sidewall surface (the sidewall surface on the outer side) 91 of the header fitting boy 90. Moreover, only some of the plural opposite surfaces 103*a* (opposite surfaces 92) may be extended from the vicinity of the end (the lower end) on the side that is fitted to the socket fitting body 40 to the vicinity of the opposite end (the upper end) in the outer sidewall surface (the sidewall surface on the outer side) 91 of the header fitting body 90.

Furthermore, the two protrusions 42 formed at the both ends in the direction Y (the longitudinal direction) are covered with two of the opposite surfaces 103*a* formed at both ends in the direction Y (the longitudinal direction) from the outside in the direction Y. The thus-configured two opposite surfaces 103*a* are formed at each side in the direction X (the width direction). Accordingly, in this embodiment, with the socket and header fitting bodies 40 and 90 fitted to each other, the regions in the socket fitting body 40 where the respective protrusions 42 are formed are sandwiched between the opposite surfaces 103*a* formed at both ends of the header fitting body 90 in the direction Y (the longitudinal direction).

As described above, in this embodiment, the opposite surfaces 103*a* are formed so as to face at least one side surface 42*a* of the both side surfaces 42*a* and 42*b* of each protrusion 42 in the width direction with the socket and header fitting bodies 40 and 90 fitted to each other.

As illustrated in FIG. 12, gaps are provided between the side surfaces 42*a* and the respective opposite surfaces 103*a* in this embodiment. This allows a little misalignment of the socket fitting body 40 and header fitting body 90. This eliminates the need to increase the fitting accuracy compared with the case where there is no gap between the side surfaces 42*a* and the respective opposite surfaces 103*a*. The socket 20 and header 70 can be, therefore, fitted to each other more easily. Herein, the allowance for misalignment is preferably smaller than the contact width between the terminal portions (the length of each contact in the direction Y). This can maintain the contacts between the terminal portions and reduce poor conduction between the terminal portions even if the socket fitting body 40 and header fitting body 90 are misaligned in the process of fitting.

As described above, the embodiment shows an example in which there is a gap between each side surface 42*a* and the corresponding opposite surface 103*a* when the socket and header fitting bodies 40 and 90 are fitted to each other. However, such a gap is not necessarily be provided between the side surfaces 42*a* and opposite surfaces 103*a* when the socket and header fitting bodies 40 and 90 are fitted to each other.

The socket terminals 30 are arranged side by side at the center of the socket housing 50 (the socket fitting body 40) in the direction Y (the longitudinal direction). The header terminals 80 are arranged side by side at the center of the header housing 100 (the header fitting body 90) in the direction Y (the longitudinal direction).

Accordingly, the protrusions 42 are formed in the portions of the inner sidewall surface (the sidewall surface on the inner side) 41 of the socket fitting body 40 that are different in the direction Y (the longitudinal direction) from the portions where the socket terminals 30 are provided.

On the other hand, the opposite surfaces 103*a* are formed at the portions corresponding to the protrusions 42 in the direction Y (the longitudinal direction) in the outer sidewall surface (the sidewall surface on the outer side) 91 of the header fitting body 90. Accordingly, the opposite surfaces 103*a* are formed in the portions different from the portions where the header terminals 80 are provided.

Moreover, as described above, the tapered portions 101*d* are formed at both ends of the long sides of the circumferential wall portion 101 in the direction Y (longitudinal direction), that is, at both ends of the header fitting body 90 in the direction Y (longitudinal direction).

In this embodiment, the opposite surfaces 103*a* are formed between the tapered portions 101*d* of the header fitting body 90 and the portion where the header terminals 80 are provided.

Furthermore, in this embodiment, protrusion pieces that protrude toward the protrusions 42 are provided in the portions corresponding to the protrusions 42 in the outer sidewall surface (the sidewall surface on the outer side) 91 of the header fitting body 90.

Specifically, recesses 101*e* recessed inward in the direction X (width direction) are formed at the portions in the header housing 100 corresponding to the protrusions 42. The end portions 112*a* of the protrusion pieces 112 of the header holding brackets 110 are protruded from the respective recesses 101*e* toward the protrusions 42. Accordingly, the end portions 112*a* of the protrusion pieces 112 correspond to the protrusion pieces in this embodiment.

Since the header holding brackets 110 are also made of metal, the end portions (protrusion pieces) 112*a* are made of metal. Furthermore, the protrusion pieces 112 are stretchable (elastically deformable) in the width direction X of the connector 10 in this embodiment. In other words, the end portions (protrusion pieces) 112*a* are made of elastic metal in this embodiment.

The top end portions (protrusion pieces) 112*a* are press-fitted and held in the header fitting body 90 in this embodiment.

Specifically, the end portions (protrusion pieces) 112*a* are provided at four places corresponding to the four protrusions 42. The two end portions (protrusion pieces) 112*a* adjacent to each other in the direction X (the width direction) are connected with a bridging portion. The two end portions (protrusion pieces) 112*a* which are adjacent in the direction X (the width direction) and are connected with the bridging portion are press-fitted into the header fitting body 90.

In other words, the end portions (protrusion pieces) 112*a* are press-fitted by press-fitting into the header housing 100 from above, each header holding bracket 110, in which the pair of protrusion pieces 112 having the respective end portions (protrusion pieces) 112*a* at the ends are connected with the joint piece 111. Accordingly, the joint piece 111 corresponds to the bridging portion.

Each header holding bracket 110 is press-fitted into the header housing 100 from above (the opposite side to the side fitted to the socket fitting body 40 in the header fitting body 90). Accordingly, the end portions (protrusion pieces) 112*a* are press-fitted in a state where the header housing 100 is placed under the header holding brackets 110 (on the side fitted to the socket fitting body 40 in the header fitting body 90).

The header holding brackets 110 are press-fitted into the both ends of the header fitting body 90 in the direction Y (the longitudinal direction), and the end portions (protrusion pieces) 112*a* are accordingly also press-fitted into the both ends of the header fitting body 90 in the direction Y (the longitudinal direction).

Furthermore, a recess 111*d* opened upward is formed at the center of the attachment piece 111*a* of the joint piece 111. In other words, the recess 111*d* is formed on the opposite side in the joint piece (bridging portion) 111 to the side fitted to the socket fitting body 40 of the header fitting body 90 with the end portions (protrusion pieces) 112*a* held in the header fitting body 90.

In this embodiment, there are a protruded portion and a recessed portion which are fitted to each other are formed inside the inner sidewall surface (the sidewall surface on the inner side) 41 in the socket fitting body 40 and inside the outer sidewall surface (the sidewall surface on the outer side) 91 in the header fitting body 90, respectively.

Specifically, the island portion 52 as the protruded portion is formed inside the inner sidewall surface (the sidewall surface on the inner side) 41 in the socket fitting body 40. The recessed portion 102 is formed inside the outer sidewall surface (the sidewall surface on the outer side) 91 in the header fitting body 90. It is possible to form the recessed portion inside the inner sidewall surface (the sidewall surface on the inner side) 41 in the socket fitting body 40 and the protruded portions inside the outer sidewall surface (the sidewall surface on the outer side) 91 in the header fitting body 90, respectively. Alternatively, plural protruded and recessed portions fitted to each other may be provided inside the respective sidewall surfaces.

In this embodiment, at least one of the inner wall surface (the sidewall surface on the inner side) 41 of the socket fitting body 40 and the outer wall surface (the sidewall surface on the outer side) 91 of the header fitting body 90 includes a protrusion as described above.

Moreover, at least one of the both side surfaces of one of the fitting bodies 40 and 90 in the width direction includes at least one protrusion that faces the opposite surface formed in the sidewall surface of the other fitting body with the socket and header fitting bodies 40 and 90 fitted to each other.

Specifically, the protrusions 42 (claw portions 65) are formed in the inner sidewall surface (the sidewall surface on the inner side) 41 of the socket fitting body 40.

Moreover, the opposite surfaces 103*a* are formed as the opposite surfaces 92 at the portions corresponding to the protrusions 42 in the outer side surfaces 103 with the socket and header fitting bodies 40 and 90 fitted to each other.

Specifically, the opposite surfaces 103*a* are formed at positions on the outside of the respective protrusions 42 in the direction Y (the longitudinal direction) so as to face the corresponding outer side surfaces 65*d* of the protrusions 42.

The socket fitting body 40 includes at least one protrusion 42 in which at least one side surface 42*a* of the both side surfaces in the width direction faces the corresponding opposite surface 103*a* formed in the sidewall surface of the header fitting body 90. Accordingly, the positioning can be made by the at least one protrusion 42 and opposite surface 103*a*. The socket and header fitting bodies 40 and 90 can be, therefore, fitted to each other more easily.

In this embodiment, in the inner sidewall surface (the sidewall surface on the inner side) 41 of the socket fitting body 40, the protrusions 42 are provided so as to protrude in the range from the vicinity of the end on the side that is fitted to the header fitting body 90 to the vicinity of the plate-shaped wall portion 56. This can facilitate the positioning. Moreover, the fitting strength between the socket and header fitting bodies 40 and 90 can be, therefore, increased.

In this embodiment, in the outer sidewall surface (the sidewall surface on the outer side) 91 of the header fitting body 90, the opposite surfaces 103*a* (the opposite surfaces 92) are provided from the vicinity of the end (the lower end) on the side that is fitted to the socket fitting body 40 to the vicinity of the opposite end (upper end) of the outer sidewall surface (sidewall surface) 91. This can further facilitate the positioning. Moreover, the fitting strength between the socket and header fitting bodies 40 and 90 can be, therefore, increased.

When the protrusions 42 and opposite surfaces 103*a* (opposite surfaces 92) are provided from the upper ends to the lower ends of the sidewall surfaces 41 and 91, respectively, in particular, the positioning can be performed more easily, and the fitting strength between the socket fitting body 40 and header fitting body 90 can be further enhanced.

In this embodiment, the protrusions 42 include at least a pair of protrusions 42, 42 which are formed at the positions point-symmetric about the center of the socket fitting body 40 in a planar view. Herein, the opposite surfaces 103*a* also include at least a pair of opposite surfaces which are formed at the positions point-symmetric about the center of the rectangular header fitting body 90 in a planar view.

As described above, when at least one pair of protrusions 42 in which at least one side surface 42*a* faces the corresponding opposite surface 103*a* formed in the sidewall surface 91 of the header fitting body 90 are provided point-symmetrically, the connector 10 can be more resistant to twist and torsion.

When the protrusions 42 are formed at both ends of the socket fitting body 40 in the direction Y (the longitudinal direction) in particular, the connector 10 can be more resistant to twist and torsion. In this case, the opposite surfaces 103*a* are also formed at both ends of the header fitting body 90 in the direction Y (the longitudinal direction).

In this embodiment, each protrusion 42 includes the inclined portion 42*c* formed on the side fitted to the socket fitting body 90 in the socket fitting body 40. By forming the inclined portions 42*c* in such a manner, the inclined portions 42*c* have a guide function in the process of fitting the socket and header fitting bodies 40 and 90. Accordingly, the socket and header fitting bodies 40 and 90 can be fitted to each other more easily.

In the embodiment, the protrusions 42 are made of metal. This can further enhance the strength of the positioning portions and further enhance the fitting strength between the socket and header fitting bodies 40 and 90.

In the embodiment, the protrusions 42 are provided at the portions of the inner sidewall surface (the sidewall surface on the inner side) 41 of the socket fitting body 40 which are different in the direction Y (longitudinal direction) from the portions where the socket terminals 30 are provided. On the other hand, the opposite surfaces 103*a* are provided in the portions different from the portion where the header terminals 80 are provided.

Accordingly, it is possible to prevent the positioning by the protrusions 42 and opposite surfaces 103*a* in the process of fitting the fitting bodies from interfering with the contacts between the socket and header terminals 30 and 80. The fitting bodies can be, therefore, fitted to each other more easily.

In the embodiment, the tapered portions 101*d* are formed at both ends of the header fitting body 90 in the direction Y (the longitudinal direction), and the opposite surfaces 103*a* are formed between the tapered portions 111*d* and the portion where the header terminals 80 are provided in the header fitting body 90.

Accordingly, when the fitting bodies are slid and fitted to each other in the aforementioned manner, the positioning portions composed of the protrusions 42 and opposite surfaces 103*a* can be prevented from coming into contact with the terminal portions (the socket terminals 30). Moreover, the provision of the tapered portions 111*d* further ensures the guide function in the process of fitting the fitting bodies.

In the embodiment, the end portions (protruding pieces) 112*a* protruding toward the respective protrusions 42 are located at the positions corresponding to the protrusions 42 in the outer sidewall surface (the sidewall surface on the outer side) 91 of the header fitting body 90. This can further enhance the fitting strength between the socket and header fitting bodies 40 and 90.

In the embodiment, the end portions (protruding pieces) 112*a* are made of elastic metal. Accordingly, the fitting strength between the socket fitting body 40 and the header fitting body 90 can be further enhanced with the minimum degradation in easy fitting of the socket and header fitting bodies 40 and 90.

In the embodiment, the two end portions (protruding pieces) 112*a* are connected with the joint piece (bridging portion) 111. Accordingly, the number of parts can be reduced. Moreover, the end portions (protruding pieces) 112*a* can be prevented from falling off in the process of detachment (detaching the header fitting body 90 from the socket fitting body 40).

In the embodiment, the end portions (protruding pieces) 112*a* are press-fitted into the header housing 100 from above (from the side opposite to the side fitted to the socket fitting body 40 in the header fitting body 90). Accordingly, the end portions (protruding pieces) 112*a* are press-fitted in the state where the header housing 100 is located under the header holding brackets 110 (on the side fitted to the socket fitting body 40 in the header fitting body 90). The header housing 100, therefore, functions as a stopper in the process of detachment (detaching the header fitting body 90 from the socket fitting body 40), thus preventing the end portions (protrusion pieces) 112*a* from falling off.

Furthermore, when the attachment pieces 111*a* of the joint pieces 111 are soldered to the second circuit substrate 140, the end portions (protrusion pieces) 112*a*, that is, the header holding brackets 110 are sandwiched between the second circuit substrate 140 and the header housing 100. This can surely prevent the end portions (protrusion pieces) 112*a* from falling off in the process of detachment (detaching the header fitting body 90 from the socket fitting body 40).

In the embodiment, the end portions (protrusion pieces) 112*a*, that is, the header holding brackets 110 are press-fitted from the both ends of the header fitting body 90 in the direction Y (the longitudinal direction).

When the header holding brackets 110 are press-fitted from the both ends of the header fitting body 90 in the direction Y (the longitudinal direction), the both ends of the header fitting body 90 in the direction Y (the longitudinal direction) are held. This ensures higher holding force against a diagonal detachment operation (an operation of rotating the header fitting body 90 about one of the long sides at the both ends in the direction X to detach the header fitting body 90 from the socket fitting body 40). In other words, it is possible to surely prevent the header fitting body 90 and socket fitting body 40 from being detached from each other when such load due to the diagonal detachment operation is inputted.

In the embodiment, the recess 111*d* is formed on the side in the joint portion (bridging portion) 111 that is opposite to the side fitted to the socket fitting body 40 of the header fitting body 90 when the end portions (protrusion pieces) 112*a* are held in the header fitting body 90.

In other words, the recess 111*d* opened upward is formed in the center of the attachment piece 111*a* of the joint piece 111.

Accordingly, in the process of soldering the attachment piece 111*a* to the second circuit substrate 140, excessive solder can be accommodated in the recess 111*d*. This can prevent the header 70 from rising from the second circuit substrate 140 by the solder for attachment.

In this embodiment, the protruded and recessed portions that are fitted to each other are respectively formed inside the inner sidewall surface (the sidewall surface on the inner side) 41 in the socket fitting body 40 and inside the outer sidewall surface (the sidewall surface on the outer side) 91 in the header fitting body 90.

Specifically, the island portion 52 as the protruded portion is formed inside the inner sidewall surface (the sidewall surface on the inner side) 41 in the socket fitting body 40. The recessed portion 102 is formed inside the outer sidewall surface (the sidewall surface on the outer side) 91 in the header fitting body 90.

Accordingly, the positioning in the process of fitting the header fitting body 90 to the socket fitting body 40 can be facilitated. Furthermore, load due to twist or the like can be received by the entire island portion 52. The resin portions (the socket housing 50 and header housing 100) are, therefore, less likely to be broken.

As described above, according to the embodiment, it is possible to obtain the connector 10 including the socket 20 and header 70 that can be easily fitted to each other and provide the header 20 and socket 70 that are used in the connector 10.

Next, a description is given of modifications of the connector 10 according to the embodiment.

(First Modification)

Figure 16:
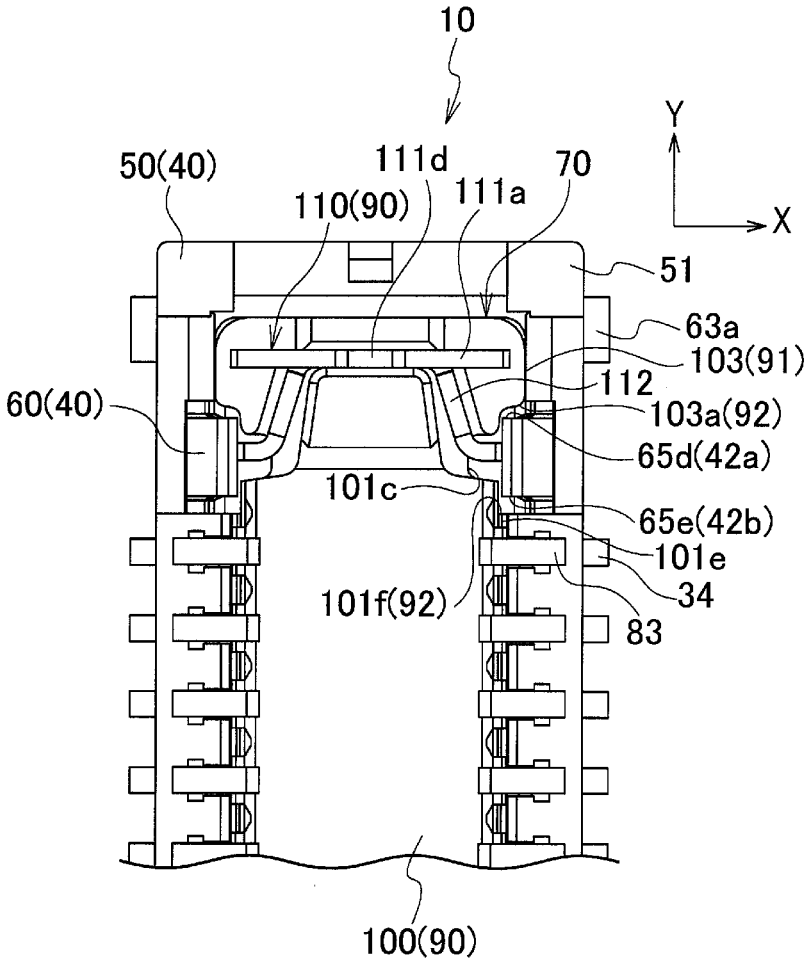
FIG. 16 is a plan view illustrating a main portion of a connector according to a first modification of the embodiment of the present invention.

FIG. 16 is a view illustrating a main portion of a connector 10 according to a first modification. The major difference between the first modification and the aforementioned embodiment is that opposite surfaces 101*f* are provided at the positions on the inside of the respective protrusions 42 in the direction Y (the longitudinal direction) so as to face the inner side surfaces 65*e* of the protrusions 42.

Specifically, the protrusions 42 are located on the inner side than those of the aforementioned embodiment so that the inner side surfaces 65*e* of the protrusions 42 may face the opposite surfaces 101*f* of the respective protruding wall portions 101*e*. The opposite surfaces 103*a* and 101*f* are, therefore, opposed to each other at the both ends of each protrusion 42 in the width direction (the direction Y).

According to the aforementioned modification, it is also possible to obtain the same operation and effects as those of the aforementioned embodiment.

(Second Modification)

Figure 17:
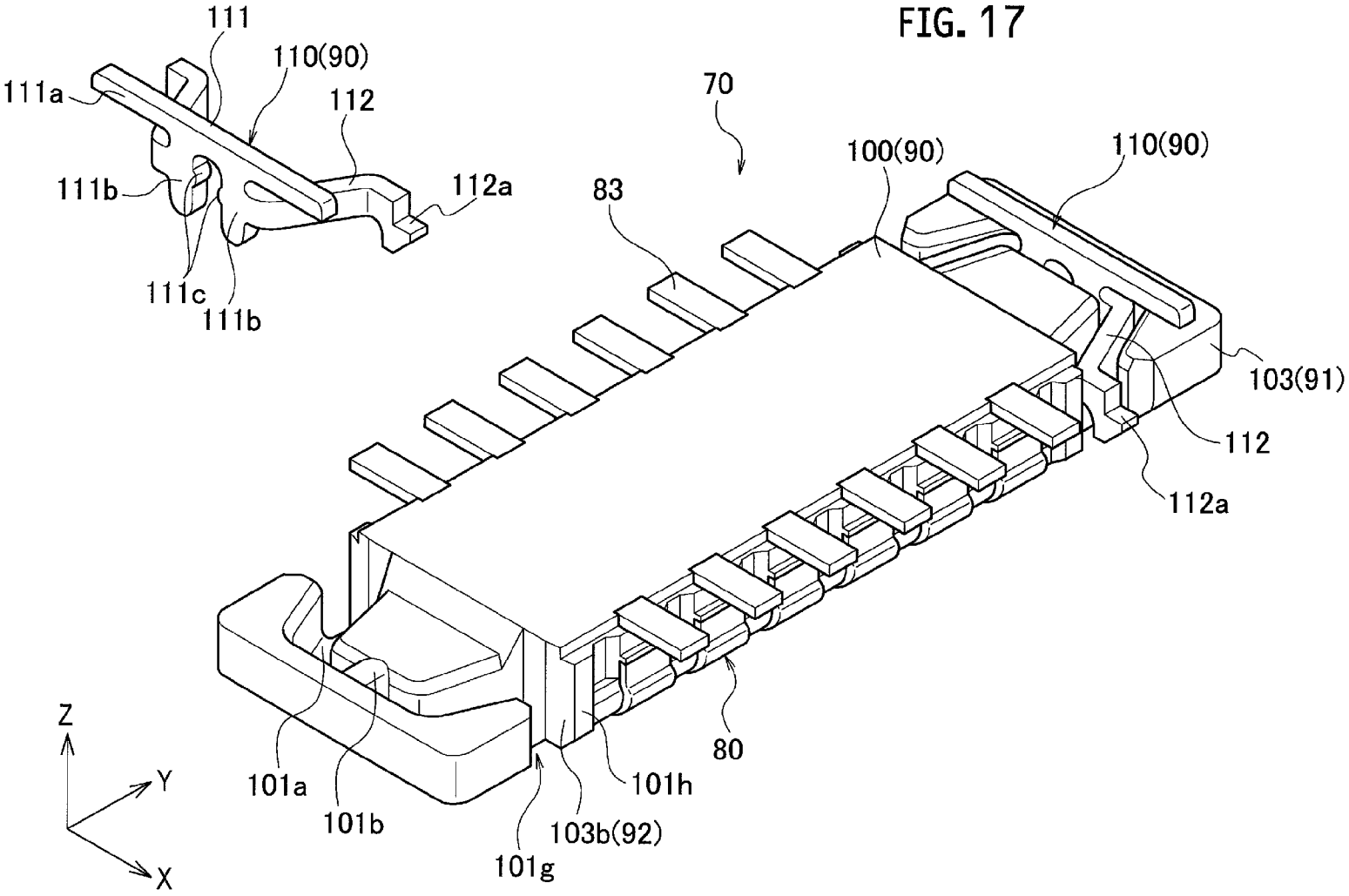
FIG. 17 is an exploded perspective view illustrating a header of a connector according to a second modification of the embodiment of the present invention.
Figure 18:
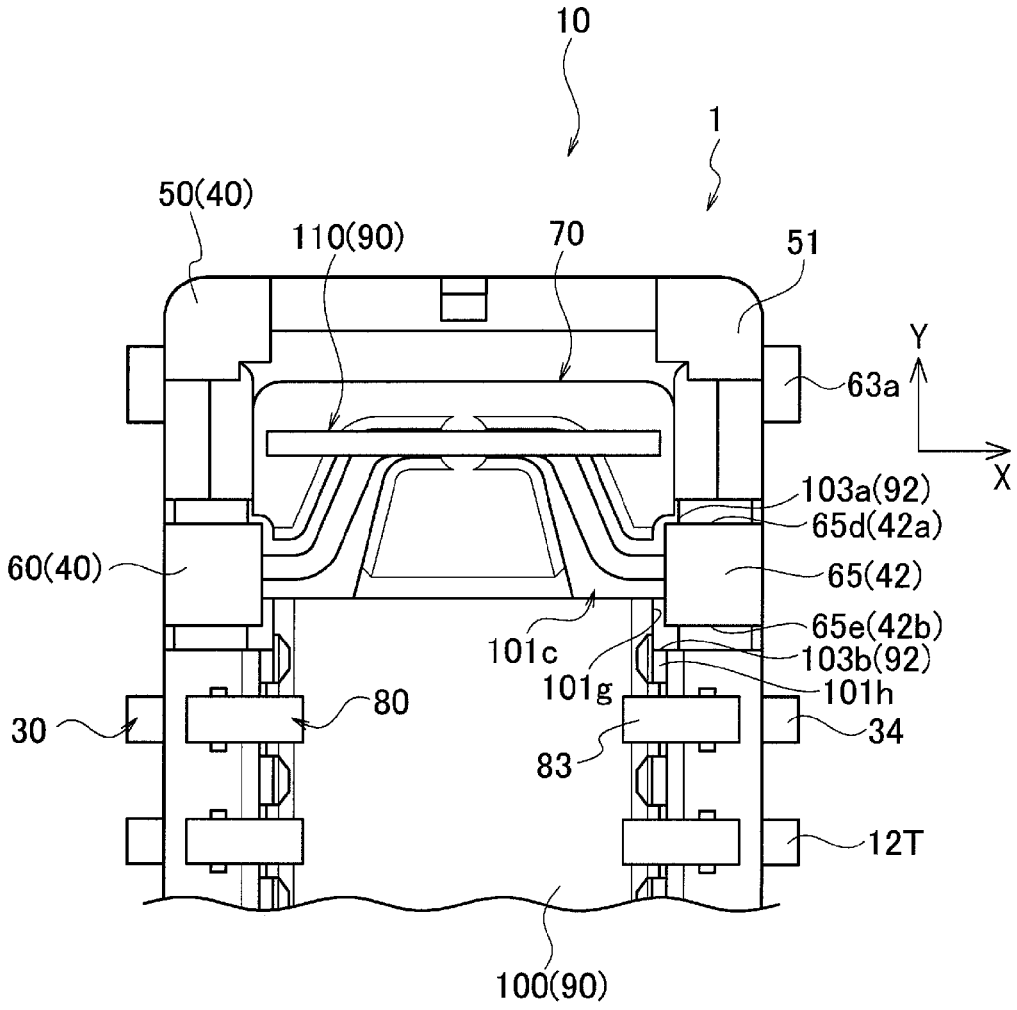
FIG. 18 is a plan view illustrating a main portion of the connector according to the second modification of the embodiment of the present invention.

FIGS. 17 and 18 are views illustrating a connector 10 according to a second modification. The second modification is mainly different from the aforementioned embodiment in that opposite surfaces 103*b* are formed at positions on the inside of the respective protrusions 42 in the direction Y (the longitudinal direction) so as to face the inner side surfaces 65*e* of the respective protrusions 42.

Specifically, wall portions 101*h* protruding outward are provided between the opposite surfaces 103*a* and header terminals 80 to form recesses 101*g*. The ends of the protrusions 42 are accommodated in the respective recesses 101*g*.

In such a manner, the opposite surfaces 103*a* and 103*b* are thus opposed to each other at both ends of each protrusion 42 in the width direction (the direction Y).

In the second modification, the header holding brackets 110 have a shape slightly different from those of the aforementioned embodiment and first modification. However, the connector 10 of the second modification can use the header holding brackets 110 shown in the embodiment and first modification. Moreover, the connector 10 of the embodiment or the first modification can use the header holding brackets shown in the second modification.

According to the second modification, it is also possible to obtain the same operation and effects as those of the aforementioned embodiment and first modification.

Hereinabove, the preferred embodiment of the present invention is described. However, the present invention is not limited to the aforementioned embodiment and can be variously changed.

For example, in the examples of the aforementioned embodiment and modifications thereof, the socket and header are rectangular. However, the present invention can be applied to the socket and header having other shapes.

Moreover, in the examples of the aforementioned embodiment and modifications thereof, the socket fitting body is formed by the socket housing and the socket holding brackets. However, the socket fitting body may be formed without the socket holding brackets.

Moreover, in the examples of the aforementioned embodiment and modifications thereof, the header fitting body is formed by the header housing and the header holding brackets. However, the header fitting body may be formed without the header holding brackets.

Furthermore, in the examples of the aforementioned embodiment and modifications thereof, the socket fitting body includes the protrusion while the header fitting body includes the opposite surface. However, the socket fitting body may include the opposite surface while the header fitting body may include the protrusion.

Still furthermore, in the examples of the aforementioned embodiment and modifications thereof, the connector 10 includes plural protrusions. However, the connector 10 may include only one protrusion. Moreover, in the examples, all of the protrusions face the respective opposite surfaces. However, the connector 10 only needs to include an opposite surface which faces at least one of the plural protrusions. In other words, one of the fitting bodies may include a protrusion whose both side surfaces do not face the sidewall portion of the other fitting body.

Furthermore, in the aforementioned examples, the protrusions are provided for either one of the socket and header fitting bodies. However, each of the socket and header fitting bodies may be configured to include at least one protrusion. Specifically, at least one protrusion is provided for the socket fitting body while an opposite surface that faces a side surface of the protrusion is provided at the portion corresponding to the protrusion in the header fitting body. Moreover, at least one protrusion is also provided for the header fitting body while an opposite surface that faces a side surface of the protrusion is provided at the portion corresponding to the protrusion (the protrusion of the header) in the socket fitting body.

The protrusions formed in either one of the fitting bodies may include a protrusion not having a side surface that faces the sidewall portion of the other fitting body. Alternatively, all the protrusions formed in anyone of the fitting bodies may be configured to include both side surfaces that do not face the sidewall portion of the other fitting body.

In other words, at least one pair of a protrusion and an opposite surface corresponding to each other needs to be provided for the socket and header fitting bodies.

Moreover, the protrusion pieces and protrusions are not necessarily made of metal.

Furthermore, the specifications (shapes, sizes, layouts, and the like) of the socket terminal, header terminals, and the other components can be properly changed.

INDUSTRIAL APPLICABILITY

According to the present invention, it is possible to provide a connector including a socket and a header that can be easily fitted to each other and provide the header and socket used in the connector.

The invention claimed is:

1. A connector, comprising:

a socket including a socket fitting body provided with socket terminals; and a header including a header fitting body provided with header terminals, the socket fitting body and header fitting body being fitted to each other to bring the socket terminals and header terminals in contact with each other, wherein at least one of a sidewall surface on an inner side of the socket fitting body and a sidewall surface on an outer side of the header fitting body includes an opposite surface, the opposite surface faces a side surface of a protrusion formed in the sidewall surface of the other fitting body with the socket and header fitting bodies fitted to each other, the side surface of the protrusion faces in an intersectional direction intersects with a protruding direction in which the protrusion is protruding, wherein the fitting body in which the opposite surface is formed includes an attachment piece attached to a circuit substrate, and the attachment piece is formed outwardly in the intersectional direction from the opposite surface so that the attachment piece and the opposite surface are not aligned along a given axis extending in the protruding direction of the protrusion.

2. The connector according to claim 1, wherein the opposite surface is formed in a portion of the sidewall surface on the outer side of the header fitting body.

3. The connector according to claim 2, wherein the opposite surface is provided from the vicinity of an end of the sidewall surface on the outer side of the header fitting body, the end being on the side fitted to the socket fitting body, to the vicinity of the opposite end of the same sidewall surface.

4. The connector according to claim 2, wherein the socket fitting body includes a plate-shaped wall portion on the side opposite to the side fitted to the header fitting body, and in the sidewall surface on the inner side of the socket fitting body, the protrusion is provided from the vicinity of an end on the side fitted to the header fitting body to the vicinity of the plate-shaped wall portion.

5. The connector according to claim 2, wherein the opposite surface includes at least a pair of opposite surfaces which are formed at the positions point-symmetric about the center of the header fitting body in a planar view.

6. The connector according to claim 2, wherein the header fitting body is rectangular, and the opposite surfaces are formed at both ends of the header fitting body in a longitudinal direction.

7. The connector according to claim 6, wherein the header fitting body includes tapered portions at both ends in the longitudinal direction, and the opposite surface is formed between the tapered portion and the portion where the header terminals are provided in the header fitting body.

8. The connector according to claim 2, wherein a protrusion piece protruding toward the protrusion is provided in a portion in the sidewall surface on the outer side of the header fitting body that correspond to the protrusion.

9. The connector according to claim 8, wherein the protrusion piece is made of elastic metal.

10. The connector according to claim 8, wherein the protrusion piece is press-fitted and held in the header fitting body.

11. The connector according to claim 10, wherein the protrusion piece is press-fitted from the side opposite to the side of the header fitting body fitted to the socket fitting body.

12. The connector according to claim 10, further comprising a plurality of protrusion pieces, wherein the protrusion pieces are press-fitted in the both ends of the header fitting body in the longitudinal direction.

13. The connector according to claim 8, wherein two of the plurality of protrusion pieces are connected by a bridging portion.

14. The connector according to claim 13, wherein the bridging portion includes a recess that is formed on the opposite side to a side fitted to the socket fitting body of the header fitting body with the protrusion pieces held by the header fitting body.

15. The connector according to claim 1, wherein a recessed portion and a protruded portion are, respectively, formed inside the sidewall surface on the inner side in the socket fitting body and inside the sidewall surface on the outer side in the header fitting body, the recessed portion and protruded portion being fitted to each other.

16. A header used in a connector, the connector, comprising:

a socket including a socket fitting body provided with socket terminals; and the header including a header fitting body provided with header terminals, the socket fitting body and header fitting body being fitted to each other to bring the socket terminals and header terminals in contact with each other, wherein at least one of a sidewall surface on an inner side of the socket fitting body and a sidewall surface on an outer side of the header fitting body includes an opposite surface, the opposite surface faces a side surface of a protrusion formed in the sidewall surface of the other fitting body with the socket and header fitting bodies fitted to each other, the side surface of the protrusion faces in an intersectional direction intersects with a protruding direction in which the protrusion is protruding, wherein the fitting body in which the opposite surface is formed includes an attachment piece attached to a circuit substrate, and the attachment piece is formed outwardly in the intersectional direction from the opposite surface so that the attachment piece and the opposite surface are not aligned along a given axis extending in the protruding direction of the protrusion.

17. A socket used in a connector, the connector, comprising:

the socket including a socket fitting body provided with socket terminals; and a header including a header fitting body provided with header terminals, the socket fitting body and header fitting body being fitted to each other to bring the socket terminals and header terminals in contact with each other, wherein at least one of a sidewall surface on an inner side of the socket fitting body and a sidewall surface on an outer side of the header fitting body includes an opposite surface, the opposite surface faces a side surface of a protrusion formed in the sidewall surface of the other fitting body with the socket and header fitting bodies fitted to each other, the side surface of the protrusion faces in an intersectional direction intersects with a protruding direction in which the protrusion is protruding, wherein the fitting body in which the opposite surface is formed includes an attachment piece attached to a circuit substrate, and the attachment piece is formed outwardly in the intersectional direction from the opposite surface so that the attachment piece and the opposite surface are not aligned along a given axis extending in the protruding direction of the protrusion.

* * * * *